US010697127B2

(12) United States Patent
Brennan et al.

(10) Patent No.: US 10,697,127 B2
(45) **Date of Patent: *Jun. 30, 2020**

(54) FIBROUS STRUCTURES AND METHODS FOR MAKING SAME

(71) Applicant: The Procter & Gamble Company, Cincinnati, OH (US)

(72) Inventors: Jonathan Paul Brennan, Sharonville, OH (US); Steven Lee Barnholtz, West Chester, OH (US); Jeffrey Len Osborne, Harrison, OH (US); Pamela Marie Morison, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/356,294

(22) Filed: Mar. 18, 2019

(65) Prior Publication Data

US 2019/0211509 A1 Jul. 11, 2019

Related U.S. Application Data

(63) Continuation of application No. 15/455,558, filed on Mar. 10, 2017, now Pat. No. 10,240,297, which is a (Continued)

(51) Int. Cl.

| | |
|---|---|
| ***D21H 27/00*** | (2006.01) |
| ***D04H 3/005*** | (2012.01) |
| ***D04H 3/015*** | (2012.01) |
| ***D04H 3/153*** | (2012.01) |
| ***D21H 11/00*** | (2006.01) |

(Continued)

(52) U.S. Cl.

CPC ..... *D21H 27/005* (2013.01); *D04H 3/005* (2013.01); *D04H 3/015* (2013.01); *D04H 3/153* (2013.01); *D21H 11/00* (2013.01); *D21H 13/14* (2013.01); *D21H 13/16* (2013.01); *D21H 13/24* (2013.01); *D21H 27/007* (2013.01);

(Continued)

(58) Field of Classification Search

CPC ..... D04H 3/005; D04H 3/015; D04H 3/153

See application file for complete search history.

(56) References Cited

U.S. PATENT DOCUMENTS 2,008,031 A 7/1931 Miller
2,175,045 A 10/1939 Vogel (Continued)

FOREIGN PATENT DOCUMENTS

DE 199 59 832 A1 7/2001
EP 0 080 382 A1 11/1982

(Continued)

OTHER PUBLICATIONS

Anonymous, "NanoDispense® Contact Angle Measurements", *First Ten Angstroms*, (Oct. 3, 2004). Retrieved from the Internet: URL: http://www.firsttenangstroms.com/pdfdocs/NanoDispenseExamples.pdf, (retrieved Feb. 15, 2011) Entire document.

(Continued)

*Primary Examiner* — Arti Singh-Pandey
(74) *Attorney, Agent, or Firm* — C. Brant Cook

(57) ABSTRACT

Fibrous structures that exhibit a novel combination of properties and to methods for making such fibrous structures are provided.

20 Claims, 10 Drawing Sheets

Related U.S. Application Data continuation of application No. 13/076,492, filed on Mar. 31, 2011, now Pat. No. 9,631,321.

(60) Provisional application No. 61/319,325, filed on Mar. 31, 2010.

(51) Int. Cl.
*D21H 13/14* (2006.01)
*D21H 13/16* (2006.01)
*D21H 13/24* (2006.01)

(52) U.S. Cl.
CPC ..... *Y10T 428/2481* (2015.01); *Y10T 428/249921* (2015.04); *Y10T 428/26* (2015.01); *Y10T 442/60* (2015.04)

(56) References Cited

U.S. PATENT DOCUMENTS 3,521,638 A 7/1970 Parrish
3,838,692 A 10/1974 Levesque
3,954,361 A 5/1976 Page
4,100,324 A 7/1978 Anderson et al.
4,118,531 A 10/1978 Hauser
4,139,699 A 2/1979 Hernandez et al.
4,203,939 A 5/1980 Drachenberg et al.
4,243,480 A 1/1981 Hernandez et al.
4,355,066 A 10/1982 Newman
4,370,289 A 1/1983 Sorenson
4,436,780 A 3/1984 Hotchkiss et al.
4,604,313 A 8/1986 McFarland et al.
4,623,576 A 11/1986 Lloyd et al.
4,634,621 A 1/1987 Manning et al.
4,636,418 A 1/1987 Kennard et al.
4,675,226 A 6/1987 Ott
4,720,415 A 1/1988 Vander Wielen et al.
4,724,114 A 2/1988 McFarland et al.
4,786,550 A 11/1988 McFarland et al.
4,803,117 A 2/1989 Daponte
4,808,467 A 2/1989 Suskind et al.
4,851,168 A 7/1989 Graiver et al.
4,855,179 A 8/1989 Bourland et al.
4,863,779 A 9/1989 Daponte
4,879,170 A 11/1989 Radwanski et al.
4,885,202 A 12/1989 Lloyd et al.
4,906,513 A 3/1990 Kebbell et al.
4,931,201 A 6/1990 Julemont
4,931,355 A 6/1990 Radwanski et al.
4,939,016 A 7/1990 Radwanski et al.
4,970,104 A 11/1990 Radwanski
5,087,506 A 2/1992 Palumbo
5,094,717 A 3/1992 Manning et al.
5,120,642 A 6/1992 Schlossman et al.
5,120,888 A 6/1992 Nohr et al.
5,144,729 A 9/1992 Austin et al.
5,145,727 A 9/1992 Potts et al.
5,149,576 A 9/1992 Potts et al.
5,160,746 A 11/1992 Dodge, II et al.
5,204,165 A 4/1993 Schortmann
5,227,107 A 7/1993 Dickenson et al.
5,254,133 A 10/1993 Seid
5,254,399 A 10/1993 Oku et al.
5,272,236 A 12/1993 Lai et al.
5,284,703 A 2/1994 Everhart et al.
5,350,624 A 9/1994 Georger et al.
5,375,306 A 12/1994 Roussin-Moynier
5,409,768 A 4/1995 Dickenson et al.
5,427,696 A 6/1995 Phan et al.
5,436,066 A 7/1995 Chen
5,476,616 A 12/1995 Schwarz
5,508,102 A 4/1996 Georger et al.
5,509,915 A 4/1996 Hanson et al.
5,536,563 A 7/1996 Shah et al.
5,539,056 A 7/1996 Yang et al.
5,587,225 A 12/1996 Griesbach et al.
5,597,873 A 1/1997 Chambers et al.
5,611,890 A 3/1997 Vinson et al.
5,629,080 A 5/1997 Gupta et al.
5,652,048 A 7/1997 Haynes et al.
5,811,178 A 9/1998 Adam et al.
5,814,570 A 9/1998 Cohen
5,834,385 A 11/1998 Blaney et al.
5,853,867 A 12/1998 Harada et al.
5,948,710 A 9/1999 Pomplun et al.
5,952,251 A 9/1999 Jackson et al.
5,962,112 A 10/1999 Haynes et al.
6,013,349 A 1/2000 Takeuchi et al.
6,028,018 A 2/2000 Amundson et al.
6,103,061 A 8/2000 Anderson et al.
6,110,848 A 8/2000 Bouchette
6,150,005 A 11/2000 Williams et al.
6,162,180 A 12/2000 Miesel et al.
6,172,276 B1 1/2001 Hetzler et al.
6,177,370 B1 1/2001 Skoog et al.
6,179,325 B1 1/2001 King
6,200,120 B1 3/2001 Fish et al.
6,296,936 B1 10/2001 Yahiaoui et al.
6,319,342 B1 11/2001 Riddell
6,348,133 B1 2/2002 Woodrum
6,348,253 B1 2/2002 Daley et al.
6,361,784 B1 3/2002 Brennan et al.
6,383,336 B1 5/2002 Shannon
6,417,120 B1 7/2002 Mitchler et al.
6,423,884 B1 7/2002 Oehmen
6,465,073 B1 10/2002 Morman et al.
6,488,801 B1 12/2002 Bodaghi et al.
6,494,974 B2 12/2002 Riddell
6,503,370 B2 1/2003 Hollmark et al.
6,506,873 B1 1/2003 Ryan et al.
6,550,115 B1 4/2003 Skoog et al.
6,589,892 B1 7/2003 Smith et al.
6,608,236 B1 8/2003 Burns et al.
6,621,679 B1 9/2003 Segervall
6,638,884 B2 10/2003 Quick et al.
6,686,303 B1 2/2004 Haynes et al.
6,709,526 B1 3/2004 Bailey et al.
6,739,023 B2 5/2004 Vonfeldt et al.
6,759,356 B1 7/2004 Myers
6,797,226 B2 9/2004 Annable
6,811,638 B2 11/2004 Close et al.
6,823,568 B1 11/2004 Kobayashi et al.
6,836,937 B1 1/2005 Boscolo
6,926,931 B2 8/2005 Qashou et al.
6,946,413 B2 9/2005 Lange et al.
6,979,386 B1 12/2005 Wallajapet et al.
6,986,932 B2 1/2006 Zink et al.
6,992,028 B2 1/2006 Thomaschefsky et al.
7,029,620 B2 1/2006 Gordon et al.
7,000,000 B1 2/2006 O'Brien
7,028,429 B1 4/2006 Druliner
7,041,369 B1 5/2006 Mackey et al.
7,176,150 B2 2/2007 Kopacz et al.
7,208,429 B2 4/2007 Vinson et al.
7,371,701 B2 5/2008 Inagaki
7,410,683 B2 8/2008 Curro et al.
7,425,517 B2 9/2008 Deka et al.
7,524,379 B2 4/2009 Bailey et al.
7,601,657 B2 10/2009 Zhou et al.
7,681,756 B2 3/2010 Baer et al.
7,696,109 B2 4/2010 Ouellette et al.
7,879,172 B2 2/2011 Kopcz et al.
7,902,096 B2 3/2011 Brandner et al.
7,972,986 B2 7/2011 Barnholtz et al.
7,976,679 B2 7/2011 Vinson et al.
7,994,079 B2 8/2011 Chen et al.
7,994,081 B2 8/2011 Farrell et al.
7,998,889 B2 8/2011 Stralin et al.
8,017,534 B2 9/2011 Harvey et al.
9,458,573 B2 * 10/2016 Barnholtz ..... D04H 1/407
10,240,297 B2 * 3/2019 Brennan ..... D04H 3/005
2003/0024662 A1 2/2003 Besemer et al.
2003/0060113 A1 3/2003 Christie et al.
2003/0073367 A1 4/2003 Kopacz et al.
2003/0131457 A1 7/2003 Krautkramer et al.

(56) References Cited

U.S. PATENT DOCUMENTS

| | | | |
|---|---|---|---|
| 2003/0135172 | A1 | 7/2003 | Whitmore et al. |
| 2003/0150090 | A1 | 8/2003 | Krautkramer et al. |
| 2003/0200991 | A1 | 10/2003 | Keck et al. |
| 2003/0211862 | A1 | 11/2003 | Keck et al. |
| 2003/0220039 | A1 | 11/2003 | Chen et al. |
| 2003/0224686 | A1 | 12/2003 | Andersen |
| 2004/0048542 | A1 | 3/2004 | Thomaschefsy et al. |
| 2004/0065422 | A1 | 4/2004 | Hu et al. |
| 2004/0087237 | A1 | 5/2004 | Garnier et al. |
| 2004/0096656 | A1 | 5/2004 | Bond |
| 2004/0106723 | A1 | 6/2004 | Yang et al. |
| 2004/0163781 | A1 | 8/2004 | Hernandez-Munoa et al. |
| 2004/0181199 | A1 | 9/2004 | Moberg-Alehammar et al. |
| 2005/0020170 | A1 | 1/2005 | Deka et al. |
| 2005/0056956 | A1 | 3/2005 | Zhao et al. |
| 2005/0090175 | A1 | 4/2005 | Bergholm et al. |
| 2005/0103455 | A1 | 5/2005 | Edwards et al. |
| 2005/0112980 | A1 | 5/2005 | Strandquist et al. |
| 2005/0130536 | A1 | 6/2005 | Siebers et al. |
| 2005/0130544 | A1 | 6/2005 | Cheng et al. |
| 2005/0133177 | A1 | 6/2005 | Stralin et al. |
| 2005/0136765 | A1 | 6/2005 | Shannon |
| 2005/0136772 | A1 | 6/2005 | Chen et al. |
| 2005/0136778 | A1 | 6/2005 | Thomaschefsky et al. |
| 2005/0137540 | A1 | 6/2005 | Villanueva et al. |
| 2005/0148262 | A1 | 7/2005 | Varona et al. |
| 2005/0148264 | A1 | 7/2005 | Varona et al. |
| 2005/0159065 | A1 | 7/2005 | Stralin et al. |
| 2005/0170727 | A1 | 8/2005 | Mekik et al. |
| 2005/0177122 | A1 | 8/2005 | Berba et al. |
| 2005/0245159 | A1 | 11/2005 | Chmielewski et al. |
| 2005/0247416 | A1 | 11/2005 | Forry et al. |
| 2005/0274470 | A1 | 12/2005 | Shannon et al. |
| 2006/0086633 | A1 | 4/2006 | Kleinsmith |
| 2006/0088697 | A1 | 4/2006 | Manifold et al. |
| 2006/0134384 | A1 | 6/2006 | Vinson et al. |
| 2007/0010153 | A1 | 1/2007 | Shaffer et al. |
| 2007/0039704 | A1 | 2/2007 | Cabell et al. |
| 2007/0049153 | A1 | 3/2007 | Dunbar et al. |
| 2007/0063091 | A1 | 3/2007 | Neveu |
| 2007/0077841 | A1 | 4/2007 | Zoch et al. |
| 2007/0173162 | A1 | 7/2007 | Ethiopia et al. |
| 2007/0202766 | A1 | 8/2007 | Ouellette et al. |
| 2007/0232180 | A1 | 10/2007 | Polat et al. |
| 2007/0272381 | A1 | 11/2007 | Elony et al. |
| 2008/0000602 | A1 | 1/2008 | Dyer et al. |
| 2008/0008853 | A1 | 1/2008 | Hupp et al. |
| 2008/0041543 | A1 | 2/2008 | Dyer et al. |
| 2008/0050996 | A1 | 2/2008 | Stralin et al. |
| 2008/0051471 | A1 | 2/2008 | Kronberg et al. |
| 2008/0142178 | A1 | 6/2008 | Haubrich et al. |
| 2008/0241538 | A1 | 10/2008 | Lee et al. |
| 2008/0248239 | A1 | 10/2008 | Pomeroy et al. |
| 2009/0022960 | A1 | 1/2009 | Suer et al. |
| 2009/0022983 | A1 | 1/2009 | Cabell et al. |
| 2009/0023839 | A1 | 1/2009 | Barnholtz et al. |
| 2009/0025894 | A1 * | 1/2009 | Barnholtz ..... D21H 27/002 162/141 |
| 2009/0084513 | A1 | 4/2009 | Barnholtz et al. |
| 2009/0093585 | A1 | 4/2009 | Smith et al. |
| 2009/0151748 | A1 | 6/2009 | Ridenhour |
| 2009/0220741 | A1 | 9/2009 | Manifold et al. |
| 2009/0220769 | A1 | 9/2009 | Manifold et al. |
| 2010/0048082 | A1 | 2/2010 | Topolkaraev et al. |
| 2010/0239825 | A1 | 9/2010 | Sheehan et al. |
| 2010/0326612 | A1 | 12/2010 | Hupp et al. |
| 2011/0039054 | A1 | 2/2011 | Cabell et al. |
| 2011/0045261 | A1 | 2/2011 | Sellars |
| 2011/0100574 | A1 | 5/2011 | Barnholtz et al. |
| 2011/0104419 | A1 | 5/2011 | Barnholtz et al. |
| 2011/0104444 | A1 | 5/2011 | Barnholtz et al. |
| 2011/0104493 | A1 | 5/2011 | Barnholtz et al. |
| 2011/0104970 | A1 | 5/2011 | Barnholtz et al. |
| 2011/0209840 | A1 | 9/2011 | Barnholtz et al. |
| 2011/0220310 | A1 | 9/2011 | Polat et al. |
| 2011/0244199 | A1 | 10/2011 | Brennan et al. |
| 2012/0318693 | A1 | 12/2012 | Barnholtz et al. |

FOREIGN PATENT DOCUMENTS

| | | | | |
|---|---|---|---|---|
| EP | 0 156 649 | A2 | 10/1985 | |
| EP | 1 156 160 | A2 | 10/1985 | |
| EP | 0 294 137 | A1 | 12/1988 | |
| EP | 0 333 209 | B1 | 9/1989 | |
| EP | 0 341 977 | A2 | 11/1989 | |
| EP | 0 205 242 | B2 | 12/1991 | |
| EP | 1 156 147 | A1 | 11/2001 | |
| EP | 1 887 036 | A2 | 2/2008 | |
| EP | 2 028 296 | A1 | 2/2009 | |
| GB | 2113731 | | 8/1983 | |
| JP | 59-211667 | A | 11/1984 | |
| JP | 08-174735 | A | 7/1996 | |
| JP | 2000/303335 | A2 | 10/2000 | |
| JP | 2002/088660 | A | 3/2002 | |
| JP | 2004-141255 | A | 5/2004 | |
| JP | 2005/218525 | A2 | 8/2005 | |
| WO | WO 94/19179 | A1 | 9/1994 | |
| WO | WO 98/55295 | A1 | 12/1998 | |
| WO | WO 00/11998 | A1 | 3/2000 | |
| WO | WO 00/29655 | A1 | 5/2000 | |
| WO | WO 00/63486 | A1 | 10/2000 | |
| WO | WO 01/09023 | A1 | 2/2001 | |
| WO | WO 01/66345 | A1 | 9/2001 | |
| WO | WO 03/050347 | A1 | 6/2003 | |
| WO | WO 03/080905 | A1 | 10/2003 | |
| WO | WO-03095731 | A1 * | 11/2003 | ..... A47L 13/16 |
| WO | WO 2005/073446 | A1 | 8/2005 | |
| WO | WO 2005/080497 | A1 | 9/2005 | |
| WO | WO 2005/106085 | A1 | 11/2005 | |
| WO | WO 2005/118934 | A1 | 12/2005 | |
| WO | WO 2006/027810 | A1 | 3/2006 | |
| WO | WO 2007/070064 | A1 | 6/2007 | |
| WO | WO 2007/070075 | A1 | 6/2007 | |
| WO | WO 2007/078344 | A1 | 7/2007 | |
| WO | WO 2007/098449 | A1 | 8/2007 | |
| WO | WO 2007/100936 | A2 | 9/2007 | |
| WO | WO 2007/124866 | A1 | 11/2007 | |
| WO | WO 2007/135624 | A2 | 11/2007 | |
| WO | WO 2008/005500 | A2 | 1/2008 | |
| WO | WO 2008/050311 | A2 | 5/2008 | |
| WO | WO 2009/010940 | A2 | 1/2009 | |
| WO | WO 2009/010941 | A2 | 1/2009 | |
| WO | WO 2009/010942 | A2 | 1/2009 | |

OTHER PUBLICATIONS

Complete Textile Glossary, Celaneses Acetate (2001), definition of "filament".

Meyer, et al., "Comparison between different presentations of pore size distribution in porous materials." Fresenius J. Anal Chem. 1999. 363: pp. 174-178.

All Office Actions in U.S. Appl. Nos. 15/455,558; 13/106,302; 16/237,943; 16/237,950; 12/170,578; 16/022,749; 16/022,749; 12/170,575; 14/475,699; 15/891,726; 12/170,557; 12/917,535; 12/917,547; 15/243,140; 12/917,558; 12/917,574; 12/917,585; 12/170,557; 13/156,413; 13/889,415; 14/970,583; 14/970,586; 13/076,492; 15/455,558; 16/356,294 and 14/970,581.

* cited by examiner

FIBROUS STRUCTURES AND METHODS FOR MAKING SAME

FIELD OF THE INVENTION

The present invention relates to fibrous structures and more particularly to fibrous structures, such as wet wipes, that exhibit a novel combination of properties, and to methods for making such fibrous structures.

BACKGROUND OF THE INVENTION

Fibrous structures are a ubiquitous part of daily life. Fibrous structures are currently used in a variety of disposable articles including, but not limited to, feminine hygiene products, diapers, training pants, adult incontinence products, paper towels, sanitary tissue products and wipes. Disposable wipes comprised of fibrous structures are widely used by consumers to clean surfaces, such as glass and ceramic tile, as well as to clean the skin of children and adults. Pre-moistened or wet wipes made of fibrous structures are also known.

Wet wipes, such as baby wipes for example, should be strong enough when pre-moistened with a lotion to maintain integrity in use, but also soft enough to give a pleasing and comfortable tactile sensation to the user(s). In addition, wet wipes should have sufficient absorbency and porosity to be effective in cleaning the soiled skin of a user while at the same time providing sufficient barrier to protect the user from contacting the soil. Protecting the user from contacting the soil creates unique "barrier" demands for fibrous structures that can negatively affect both the fibrous structures' absorbency and lotion release. Moreover, wet wipes should have absorbency properties such that each wipe of a stack remains wet during extended storage periods but yet at the same time easily releases lotion during use.

Consumers of fibrous structures, especially baby wipes, require absorbency properties (such as absorption capacity) in their fibrous structures. In the past, some fibrous structures exhibit a relatively high level of absorbency capacity (about 10 g/g) which improves the lotion retention and uniform distribution of moisture in a stack of wipes over time. Other fibrous structures exhibit pore volume distributions that enable lower absorbency capacities (about 5 to 8 g/g) which increases the ability of the lotion to release from the wipe at the expense of a uniform distribution of moisture throughout a stack. In addition due to cost and environmental sustainability concerns, there is a need to further improve the absorbency capacity of wipes to enable better cleaning with less material without further compromising lotion release and other important properties such as tensile strength and protection.

Accordingly, there is a need for fibrous structures that exhibit a high degree of absorbency, coupled with barrier protection, sufficient lotion release for cleaning, stable moisture distribution and/or strength in use all while using less material.

SUMMARY OF THE INVENTION

The present invention solves the problem identified above by fulfilling the needs of the consumers by providing fibrous structures that exhibit a novel combination of properties and methods for making such fibrous structures.

In one example of the present invention, a fibrous structure that exhibits a Liquid Absorptive Capacity of greater than 12 g/g as measured according to the Liquid Absorptive Capacity Test Method described herein and a Soil Leak Through Lr Value of less than 8.5 as measured according to the Soil Leak Through Test Method described herein, is provided.

In another example of the present invention, a fibrous structure comprising a plurality of filaments, wherein the fibrous structure exhibits a pore volume distribution such that at least 43% and/or at least 45% and/or at least 50% and/or at least 55% and/or at least 60% and/or at least 75% of the total pore volume present in the fibrous structures exists in pores of radii of from 91 μm to about 140 μm as determined by the Pore Volume Distribution Test Method described herein and a Saturation Gradient Index of less than 1.8 and/or less than 1.6 and/or less than a 1.5 and/or less than 1.4 and/or less than 1.3, is provided.

In another example of the present invention, a fibrous structure comprising a plurality of filaments, wherein the fibrous structure exhibits a pore volume distribution such that at least 43% and/or at least 45% and/or at least 50% and/or at least 55% and/or at least 60% and/or at least 75% of the total pore volume present in the fibrous structures exists in pores of radii of from 91 μm to about 140 μm as determined by the Pore Volume Distribution Test Method described herein and a Liquid Absorptive Capacity of greater than 11 g/g and/or greater than 12 g/g and/or greater than 13 g/g and/or greater than 14 g/g and/or greater than 15 g/g as measured according to the Liquid Absorptive Capacity Test Method described herein, is provided.

In yet another example of the present invention, a fibrous structure comprising a plurality of filaments, wherein the fibrous structure exhibits a pore volume distribution such that at least 30% and/or at least 40% and/or at least 50% and/or at least 55% and/or at least 60% and/or at least 75% of the total pore volume present in the fibrous structures exists in pores of radii of from about 121 μm to about 200 μm as determined by the Pore Volume Distribution Test Method described herein and a Saturation Gradient Index of less than 1.8 and/or less than 1.6 and/or less than a 1.5 and/or less than 1.4 and/or less than 1.3, is provided.

In still another example of the present invention, a fibrous structure comprising a plurality of filaments, wherein the fibrous structure exhibits a pore volume distribution such that at least 50% and/or at least 55% and/or at least 60% and/or at least 75% of the total pore volume present in the fibrous structures exists in pores of radii of from about 101 μm to about 200 μm as determined by the Pore Volume Distribution Test Method described herein and a Liquid Absorptive Capacity of greater than 11 g/g and/or greater than 12 g/g and/or greater than 13 g/g and/or greater than 14 g/g and/or greater than 15 g/g as measured according to the Liquid Absorptive Capacity Test Method described herein, is provided.

In even yet another example of the present invention, a fibrous structure comprising a plurality of filaments, wherein the fibrous structure exhibits a pore volume distribution such that at least 30% and/or at least 40% and/or at least 50% and/or at least 55% and/or at least 60% and/or at least 75% of the total pore volume present in the fibrous structures exists in pores of radii of from about 121 μm to about 200 μm as determined by the Pore Volume Distribution Test Method described herein and exhibits a pore volume distribution such that at least 50% and/or at least 55% and/or at least 60% and/or at least 75% of the total pore volume present in the fibrous structures exists in pores of radii of from about 101 μm to about 200 μm as determined by the Pore Volume Distribution Test Method described herein and a Saturation Gradient Index of less than 1.8 and/or less than 1.6 and/or less than a 1.5 and/or less than 1.4 and/or less than 1.3, is provided.

In even yet another example of the present invention, a fibrous structure comprising a plurality of filaments, wherein the fibrous structure exhibits a pore volume distribution such that at least 30% and/or at least 40% and/or at least 50% and/or at least 55% and/or at least 60% and/or at least 75% of the total pore volume present in the fibrous structures exists in pores of radii of from about 121 μm to about 200 μm as determined by the Pore Volume Distribution Test Method described herein and exhibits a pore volume distribution such that at least 50% and/or at least 55% and/or at least 60% and/or at least 75% of the total pore volume present in the fibrous structures exists in pores of radii of from about 101 μm to about 200 μm as determined by the Pore Volume Distribution Test Method described herein and a Liquid Absorptive Capacity of greater than 11 g/g and/or greater than 12 g/g and/or greater than 13 g/g and/or greater than 14 g/g and/or greater than 15 g/g as measured according to the Liquid Absorptive Capacity Test Method described herein, is provided.

In yet another example of the present invention, a fibrous structure comprising a plurality of filaments, wherein the fibrous structure exhibits a Liquid Absorptive Capacity of greater than 11 g/g and/or greater than 12 g/g and/or greater than 13 g/g and/or greater than 14 g/g and/or greater than 15 g/g as measured according to the Liquid Absorptive Capacity Test Method described herein and a Saturation Gradient Index of less than 1.8 and/or less than 1.6 and/or less than a 1.5 and/or less than 1.4 and/or less than 1.3, is provided.

In even another example of the present invention, a fibrous structure comprising a plurality of filaments, wherein the fibrous structure exhibits a Liquid Absorptive Capacity of greater than 11 g/g and/or greater than 12 g/g and/or greater than 13 g/g and/or greater than 14 g/g and/or greater than 15 g/g as measured according to the Liquid Absorptive Capacity Test Method described herein and a Lotion Release of greater than 0.25 and/or greater than 0.27 and/or greater than 0.30 and/or greater than 0.32 as measured according to the Lotion Release Test Method described herein, is provided.

In still another example of the present invention, a fibrous structure comprising a plurality of filaments, wherein the fibrous structure exhibits a Basis Weight of less than 55 $g/m^2$ and/or less than 50 $g/m^2$ and/or less than 47 $g/m^2$ and/or less than 45 $g/m^2$ and/or less than 40 $g/m^2$ and/or less than 35 $g/m^2$ and/or to greater than 20 $g/m^2$ and/or greater than 25 $g/m^2$ and/or greater than 30 $g/m^2$ as measured according to the Basis Weight Test Method described herein, a CD Wet Initial Tensile Strength of greater than 5.0 N as measured according to the CD Wet Initial Tensile Strength Test Method described herein, and a Liquid Absorptive Capacity of greater than 11 g/g and/or greater than 12 g/g and/or greater than 13 g/g and/or greater than 14 g/g and/or greater than 15 g/g as measured according to the Liquid Absorptive Capacity Test Method described herein, is provided.

In still yet another example of the present invention, a fibrous structure, for example coformed fibrous structure, comprising a plurality of filaments and a plurality of solid additives, wherein the fibrous structure exhibits a Basis Weight of less than 55 $g/m^2$ and/or less than 50 $g/m^2$ and/or less than 47 $g/m^2$ and/or less than 45 $g/m^2$ and/or less than 40 $g/m^2$ and/or less than 35 $g/m^2$ and/or to greater than 20 $g/m^2$ and/or greater than 25 $g/m^2$ and/or greater than 30 $g/m^2$ as measured according to the Basis Weight Test Method described herein, a CD Wet Initial Tensile Strength of greater than 5.0 N and/or greater than 5.2 N and/or greater than 5.5 N and/or greater than 6.0 N as measured according to the CD Wet Initial Tensile Strength Test Method described herein, is provided.

In yet another example of the present invention, a sanitary tissue product comprising a fibrous structure according to the present invention is provided.

Accordingly, the present invention provides fibrous structures that solve the problems described above by providing fibrous structures that exhibit certain properties that are consumer desirable and to methods for making such fibrous structures.

DETAILED DESCRIPTION OF THE INVENTION

Definitions

Figure 1:
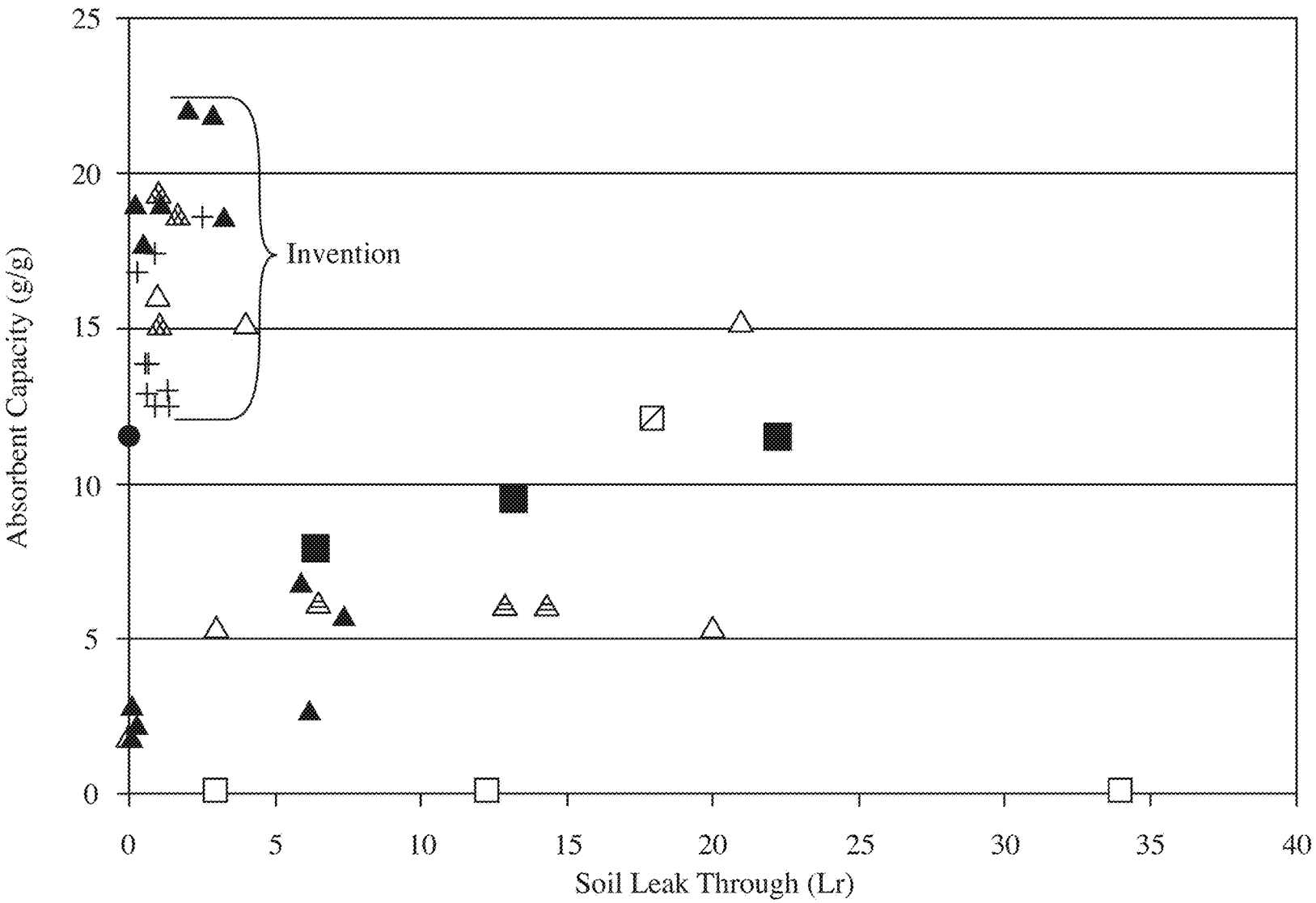
FIG. 1 is a plot of Liquid Absorptive Capacity ("Absorbent Capacity") (g/g) versus Soil Leak Through (Lr) Value of known or commercially available fibrous structures/wipes and fibrous structures/wipes according to the present invention.

"Fibrous structure" as used herein means a structure that comprises one or more filaments and/or fibers. In one example, the fibrous structure is a wipe, such as a wet wipe, for example a baby wipe. For example, "fibrous structure" and "wipe" may be used interchangeably herein. In one example, a fibrous structure according to the present invention means an orderly arrangement of filaments and/or fibers within a structure in order to perform a function. In another example, a fibrous structure according to the present invention is a nonwoven.

Non-limiting examples of processes for making fibrous structures include known wet-laid papermaking processes, air-laid papermaking processes including carded and/or spunlaced processes. Such processes typically include steps of preparing a fiber composition in the form of a suspension in a medium, either wet, more specifically aqueous medium, or dry, more specifically gaseous, i.e. with air as medium. The aqueous medium used for wet-laid processes is oftentimes referred to as a fiber slurry. The fibrous slurry is then used to deposit a plurality of fibers onto a forming wire or belt such that an embryonic fibrous structure is formed, after which drying and/or bonding the fibers together results in a fibrous structure. Further processing the fibrous structure may be carried out such that a finished fibrous structure is formed. For example, in typical papermaking processes, the finished fibrous structure is the fibrous structure that is wound on the reel at the end of papermaking, and may subsequently be converted into a finished product, e.g. a sanitary tissue product.

The fibrous structures of the present invention may be homogeneous or may be layered. If layered, the fibrous structures may comprise at least two and/or at least three and/or at least four and/or at least five layers.

In one example the fibrous structure is a nonwoven.

"Nonwoven" for purposes of the present invention as used herein and as defined by EDANA means a sheet of fibers, continuous filaments, or chopped yarns of any nature or origin, that have been formed into a web by any means, and bonded together by any means, with the exception of weaving or knitting. Felts obtained by wet milling are not nonwovens. Wetlaid webs are nonwovens provided that they contain a minimum of 50% by weight of man-made fibers, filaments or other fibers of non-vegetable origin with a length to diameter ratio that equals or exceeds 300 or a minimum of 30% by weight of man-made fibers, filaments or other fibers of non-vegetable origin with a length to diameter ratio that equals or exceeds 600 and a maximum apparent density of 0.40 g/cm$^3$.

The fibrous structures of the present invention may be co-formed fibrous structures.

"Co-formed fibrous structure" as used herein means that the fibrous structure comprises a mixture of at least two different materials wherein at least one of the materials comprises a filament, such as a polypropylene filament, and at least one other material, different from the first material, comprises a solid additive, such as a fiber and/or a particulate. In one example, a co-formed fibrous structure comprises solid additives, such as fibers, such as wood pulp fibers and/or absorbent gel materials and/or filler particles and/or particulate spot bonding powders and/or clays, and filaments, such as polypropylene filaments.

"Solid additive" as used herein means a fiber and/or a particulate.

"Particulate" as used herein means a granular substance or powder.

"Fiber" and/or "Filament" as used herein means an elongate particulate having an apparent length greatly exceeding its apparent width, i.e. a length to diameter ratio of at least about 10. For purposes of the present invention, a "fiber" is an elongate particulate as described above that exhibits a length of less than 5.08 cm (2 in.) and a "filament" is an elongate particulate as described above that exhibits a length of greater than or equal to 5.08 cm (2 in.).

Fibers are typically considered discontinuous in nature. Non-limiting examples of fibers include wood pulp fibers, rayon, which in turn includes but is not limited to viscose, lyocell, cotton; wool; silk; jute; linen; ramie; hemp; flax; camel hair; kenaf; and synthetic staple fibers made from polyester, nylons, polyolefins such as polypropylene, polyethylene, natural polymers, such as starch, starch derivatives, cellulose and cellulose derivatives, hemicellulose, hemicellulose derivatives, chitin, chitosan, polyisoprene (cis and trans), peptides, polyhydroxyalkanoates, copolymers of polyolefins such as polyethylene-octene, and biodegradable or compostable thermoplastic fibers such as polylactic acid filaments, polyvinyl alcohol filaments, and polycaprolactone filaments. The fibers may be monocomponent or multicomponent, such as bicomponent filaments, round, non-round fibers; and combinations thereof.

Filaments are typically considered continuous or substantially continuous in nature. Filaments are relatively longer than fibers. Non-limiting examples of filaments include meltblown and/or spunbond filaments. Non-limiting examples of materials that can be spun into filaments include natural polymers, such as starch, starch derivatives, cellulose and cellulose derivatives, hemicellulose, hemicellulose derivatives, chitin, chitosan, polyisoprene (cis and trans), peptides, polyhydroxyalkanoates, and synthetic polymers including, but not limited to, thermoplastic polymer filaments comprising thermoplastic polymers, such as polyesters, nylons, polyolefins such as polypropylene filaments, polyethylene filaments, polyvinyl alcohol and polyvinyl alcohol derivatives, sodium polyacrylate (absorbent gel material) filaments, and copolymers of polyolefins such as polyethylene-octene, and biodegradable or compostable thermoplastic fibers such as polylactic acid filaments, polyvinyl alcohol filaments, and polycaprolactone filaments. The filaments may be monocomponent or multicomponent, such as bicomponent filaments.

In one example of the present invention, "fiber" refers to papermaking fibers. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified web. U.S. Pat. No. 4,300,981 and U.S. Pat. No. 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking.

In addition to the various wood pulp fibers, other cellulosic fibers such as cotton linters, rayon, lyocell and bagasse can be used in this invention. Other sources of cellulose in the form of fibers or capable of being spun into fibers include grasses and grain sources.

"Sanitary tissue product" as used herein means a soft, low density (i.e. <about 0.15 g/cm$^3$) web useful as a wiping implement for post-urinary and post-bowel movement cleaning (toilet tissue), for otorhinolaryngological discharges (facial tissue), and multi-functional absorbent and cleaning uses (absorbent towels). Non-limiting examples of suitable sanitary tissue products of the present invention include paper towels, bath tissue, facial tissue, napkins, baby wipes, adult wipes, wet wipes, cleaning wipes, polishing wipes, cosmetic wipes, car care wipes, wipes that comprise an active agent for performing a particular function, cleaning substrates for use with implements, such as a Swifter® cleaning wipe/pad. The sanitary tissue product may be convolutedly wound upon itself about a core or without a core to form a sanitary tissue product roll.

In one example, the sanitary tissue product of the present invention comprises a fibrous structure according to the present invention.

The sanitary tissue products of the present invention may exhibit a basis weight between about 10 $g/m^2$ to about 120 $g/m^2$ and/or from about 15 $g/m^2$ to about 110 $g/m^2$ and/or from about 20 $g/m^2$ to about 100 $g/m^2$ and/or from about 30 to 90 $g/m^2$. In addition, the sanitary tissue product of the present invention may exhibit a basis weight between about 40 $g/m^2$ to about 120 $g/m^2$ and/or from about 50 $g/m^2$ to about 110 $g/m^2$ and/or from about 55 $g/m^2$ to about 105 $g/m^2$ and/or from about 60 to 100 $g/m^2$. In one example, the sanitary tissue product exhibits a basis weight of less than 55 $g/m^2$ and/or less than 50 $g/m^2$ and/or less than 47 $g/m^2$ and/or less than 45 $g/m^2$ and/or less than 40 $g/m^2$ and/or less than 35 $g/m^2$ and/or to greater than 20 $g/m^2$ and/or greater than 25 $g/m^2$ and/or greater than 30 $g/m^2$ as measured according to the Basis Weight Test Method described herein.

In one example, the sanitary tissue product of the present invention may exhibit a CD Wet Initial Tensile Strength of /or greater than 5.0 N and/or greater than 5.5 N and/or greater than 6.0 N as measured according to the CD Wet Initial Tensile Strength Test Method described herein.

The sanitary tissue products of the present invention may exhibit a density (measured at 95 $g/in^2$) of less than about 0.60 $g/cm^3$ and/or less than about 0.30 $g/cm^3$ and/or less than about 0.20 $g/cm^3$ and/or less than about 0.10 $g/cm^3$ and/or less than about 0.07 $g/cm^3$ and/or less than about 0.05 $g/cm^3$ and/or from about 0.01 $g/cm^3$ to about 0.20 $g/cm^3$ and/or from about 0.02 $g/cm^3$ to about 0.10 $g/cm^3$.

The sanitary tissue products of the present invention may comprise additives such as softening agents, temporary wet strength agents, permanent wet strength agents, bulk softening agents, silicones, wetting agents, latexes, especially surface-pattern-applied latexes, dry strength agents such as carboxymethylcellulose and starch, and other types of additives suitable for inclusion in and/or on sanitary tissue products.

"Weight average molecular weight" as used herein means the weight average molecular weight as determined using gel permeation chromatography according to the protocol found in Colloids and Surfaces A. Physico Chemical & Engineering Aspects, Vol. 162, 2000, pg. 107-121.

"Basis Weight" as used herein is the weight per unit area of a sample reported in lbs/3000 $ft^2$ or $g/m^2$ (gsm).

"Stack" as used herein, refers to a neat pile of fibrous structures and/or wipes. Based upon the assumption that there are at least three wipes in a stack, each wipe, except for the topmost and bottommost wipes in the stack, will be directly in face to face contact with the wipe directly above and below itself in the stack. Moreover, when viewed from above, the wipes will be layered on top of each other, or superimposed, such that only the topmost wipe of the stack will be visible. The height of the stack is measured from the bottom of the bottommost wipe in the stack to the top of the topmost wipe in the stack and is provided in units of millimeters (mm).

"Liquid composition" and "lotion" are used interchangeably herein and refer to any liquid, including, but not limited to a pure liquid such as water, an aqueous solution, a colloid, an emulsion, a suspension, a solution and mixtures thereof. The term "aqueous solution" as used herein, refers to a solution that is at least about 20%, at least about 40%, or even at least about 50% water by weight, and is no more than about 95%, or no more than about 90% water by weight.

In one example, the liquid composition comprises water or another liquid solvent. Generally the liquid composition is of sufficiently low viscosity to impregnate the entire structure of the fibrous structure. In another example, the liquid composition may be primarily present at the fibrous structure surface and to a lesser extent in the inner structure of the fibrous structure. In a further example, the liquid composition is releasably carried by the fibrous structure, that is the liquid composition is carried on or in the fibrous structure and is readily releasable from the fibrous structure by applying some force to the fibrous structure, for example by wiping a surface with the fibrous structure.

The liquid compositions used in the present invention are primarily although not limited to, oil in water emulsions. In one example, the liquid composition of the present invention comprises at least 80% and/or at least 85% and/or at least 90% and/or at least 95% by weight water.

When present on or in the fibrous structure, the liquid composition may be present at a level of from about 10% to about 1000% of the basis weight of the fibrous structure and/or from about 100% to about 700% of the basis weight of the fibrous structure and/or from about 200% to about 500% and/or from about 200% to about 400% of the basis weight of the fibrous structure.

The liquid composition may comprise an acid. Non-limiting examples of acids that can be used in the liquid composition of the present invention are adipic acid, tartaric acid, citric acid, maleic acid, malic acid, succinic acid, glycolic acid, glutaric acid, malonic acid, salicylic acid, gluconic acid, polymeric acids, phosphoric acid, carbonic acid, fumaric acid and phthalic acid and mixtures thereof. Suitable polymeric acids can include homopolymers, copolymers and terpolymers, and may contain at least 30 mole % carboxylic acid groups. Specific examples of suitable polymeric acids useful herein include straight-chain poly (acrylic) acid and its copolymers, both ionic and nonionic, (e.g., maleic-acrylic, sulfonic-acrylic, and styrene-acrylic copolymers), those cross-linked polyacrylic acids having a molecular weight of less than about 250,000, preferably less than about 100,000 poly ($\alpha$-hydroxy) acids, poly (methacrylic) acid, and naturally occurring polymeric acids such as carageenic acid, carboxy methyl cellulose, and alginic acid. In one example, the liquid composition comprises citric acid and/or citric acid derivatives.

The liquid composition may also contain salts of the acid or acids used to lower the pH, or another weak base to impart buffering properties to the fibrous structure. The buffering response is due to the equilibrium which is set up between the free acid and its salt. This allows the fibrous structure to maintain its overall pH despite encountering a relatively high amount of bodily waste as would be found post urination or defecation in a baby or adult. In one embodiment the acid salt would be sodium citrate. The amount of sodium citrate present in the lotion would be between 0.01 and 2.0%, alternatively 0.1 and 1.25%, or alternatively 0.2 and 0.7% of the lotion.

In one example, the liquid composition does not contain any preservative compounds.

In addition to the above ingredients, the liquid composition may comprise addition ingredients. Non-limiting examples of additional ingredients that may be present in the liquid composition of the present invention include: skin conditioning agents (emollients, humectants) including, waxes such as petrolatum, cholesterol and cholesterol derivatives, di and tri-glycerides including sunflower oil and sesame oil, silicone oils such as dimethicone copolyol, caprylyl glycol and acetoglycerides such as lanolin and its derivatives, emulsifiers; stabilizers; surfactants including anionic, amphoteric, cationic and non ionic surfactants, colourants, chelating agents including EDTA, sun screen agents, solubilizing agents, perfumes, opacifying agents, vitamins, viscosity modifiers; such as xanthan gum, astringents and external analgesics.

"Pre-moistened" and "wet" are used interchangeably herein and refer to fibrous structures and/or wipes which are moistened with a liquid composition prior to packaging in a generally moisture impervious container or wrapper. Such pre-moistened wipes, which can also be referred to as "wet wipes" and "towelettes", may be suitable for use in cleaning babies, as well as older children and adults.

"Saturation loading" and "lotion loading" are used interchangeably herein and refer to the amount of liquid composition applied to the fibrous structure or wipe. In general, the amount of liquid composition applied may be chosen in order to provide maximum benefits to the end product comprised by the wipe. Saturation loading is typically expressed as grams of liquid composition per gram of dry wipe.

Saturation loading, often expressed as percent saturation, is defined as the percentage of the dry fibrous structure or wipe's mass (void of any liquid composition) that a liquid composition present on/in the fibrous structure or wipe represents. For example, a saturation loading of 1.0 (equivalently, 100% saturation) indicates that the mass of liquid composition present on/in the fibrous structure or wipe is equal to the mass of dry fibrous structure or wipe (void of any liquid composition).

The following equation is used to calculate saturation load of a fibrous structure or wipe:

$$\text{Saturation Loading} = \left[\frac{\text{wet wipe mass}}{(\text{wipe size}) * (\text{basis weight})}\right] - 1$$

"Saturation gradient index" (SGI) is a measure of how well the wipes at the top of a stack retain moisture. The SGI of a stack of wipes is measured as described infra and is calculated as the ratio of the average lotion load of the bottommost wipes in the stack versus the topmost wipes in the stack. The ideal stack of wipes will have an SGI of about 1.0; that is, the topmost wipes will be equally as moist as the bottommost wipes. In the aforementioned embodiments, the stacks have a SGI from about 1.0 to about 1.5.

The saturation gradient index for a fibrous structure or wipe stack is calculated as the ratio of the saturation loading of a set number of fibrous structures or wipes from the bottom of a stack to that of the same number of fibrous structures or wipes from the top of the stack. For example, for an approximately 80 count wipe stack, the saturation gradient index is this ratio using 10 wipes from bottom and top; for an approximately 30 count wipe stack, 5 wipes from bottom and top are used; and for less than 30, only the top and bottom single wipes are used in the saturation gradient index calculation. The following equation illustrates the example of an 80 count stack saturation gradient index calculation:

$$\text{Saturation Gradient Index} = \frac{\text{average lotion load of bottom 10 wipes in stack}}{\text{average lotion load of top 10 wipes in stack}}$$

A saturation profile, or wetness gradient, exists in the stack when the saturation gradient index is greater than 1.0. In cases where the saturation gradient index is significantly greater than 1.0, e.g. over about 1.5, lotion is draining from the top of the stack and settling in the bottom of the container, such that there may be a noticeable difference in the wetness of the topmost fibrous structures or wipes in the stack compared to that of the fibrous structures or wipes nearest the bottom of the stack. For example, a perfect tub of wipes would have a saturation gradient index of 1.0; the bottommost wipes and topmost wipes would maintain equivalent saturation loading during storage. Additional liquid composition would not be needed to supersaturate the wipes in an effort to keep all of the wipes moist, which typically results in the bottommost wipes being soggy.

"Percent moisture" or "% moisture" or "moisture level" as used herein means 100×(the ratio of the mass of water contained in a fibrous structure to the mass of the fibrous structure). The product of the above equation is reported as a %.

"Surface tension" as used herein, refers to the force at the interface between a liquid composition and air. Surface tension is typically expressed in dynes per centimeter (dynes/cm).

"Surfactant" as used herein, refers to materials which preferably orient toward an interface. Surfactants include the various surfactants known in the art, including: nonionic surfactants; anionic surfactants; cationic surfactants; amphoteric surfactants, zwitterionic surfactants; and mixtures thereof.

"Visible" as used herein, refers to being capable of being seen by the naked eye when viewed at a distance of 12 inches (in), or 30.48 centimeters (cm), under the unimpeded light of an ordinary incandescent 60 watt light bulb that is inserted in a fixture such as a table lamp. It follows that "visually distinct" as used herein refers to those features of nonwoven wipes, whether or not they are pre-moistened, that are readily visible and discernable when the wipe is subjected to normal use, such as the cleaning of a child's skin.

"Machine Direction" or "MD" as used herein means the direction parallel to the flow of the fibrous structure through the fibrous structure making machine and/or sanitary tissue product manufacturing equipment.

"Cross Machine Direction" or "CD" as used herein means the direction parallel to the width of the fibrous structure making machine and/or sanitary tissue product manufacturing equipment and perpendicular to the machine direction.

"Ply" as used herein means an individual, integral fibrous structure.

"Plies" as used herein means two or more individual, integral fibrous structures disposed in a substantially contiguous, face-to-face relationship with one another, forming a multi-ply fibrous structure and/or multi-ply sanitary tissue product. It is also contemplated that an individual, integral fibrous structure can effectively form a multi-ply fibrous structure, for example, by being folded on itself.

"Total Pore Volume" as used herein means the sum of the fluid holding void volume in each pore range from 2.5 μm to 1000 μm radii as measured according to the Pore Volume Test Method described herein.

"Pore Volume Distribution" as used herein means the distribution of fluid holding void volume as a function of pore radius. The Pore Volume Distribution of a fibrous structure is measured according to the Pore Volume Test Method described herein.

As used herein, the articles "a" and "an" when used herein, for example, "an anionic surfactant" or "a fiber" is understood to mean one or more of the material that is claimed or described.

All percentages and ratios are calculated by weight unless otherwise indicated. All percentages and ratios are calculated based on the total composition unless otherwise indicated.

Unless otherwise noted, all component or composition levels are in reference to the active level of that component or composition, and are exclusive of impurities, for example, residual solvents or by-products, which may be present in commercially available sources.

Fibrous Structure

It has surprisingly been found that the fibrous structures of the present invention exhibit a Liquid Absorptive Capacity higher than other known structured and/or textured fibrous structures as measured according to the Liquid Absorptive Capacity Test Method described herein.

FIG. 1 shows that the fibrous structures and/or wipes of the present invention comprise a novel combination of Liquid Absorptive Capacity and Soil Leak Through.

Figure 2:
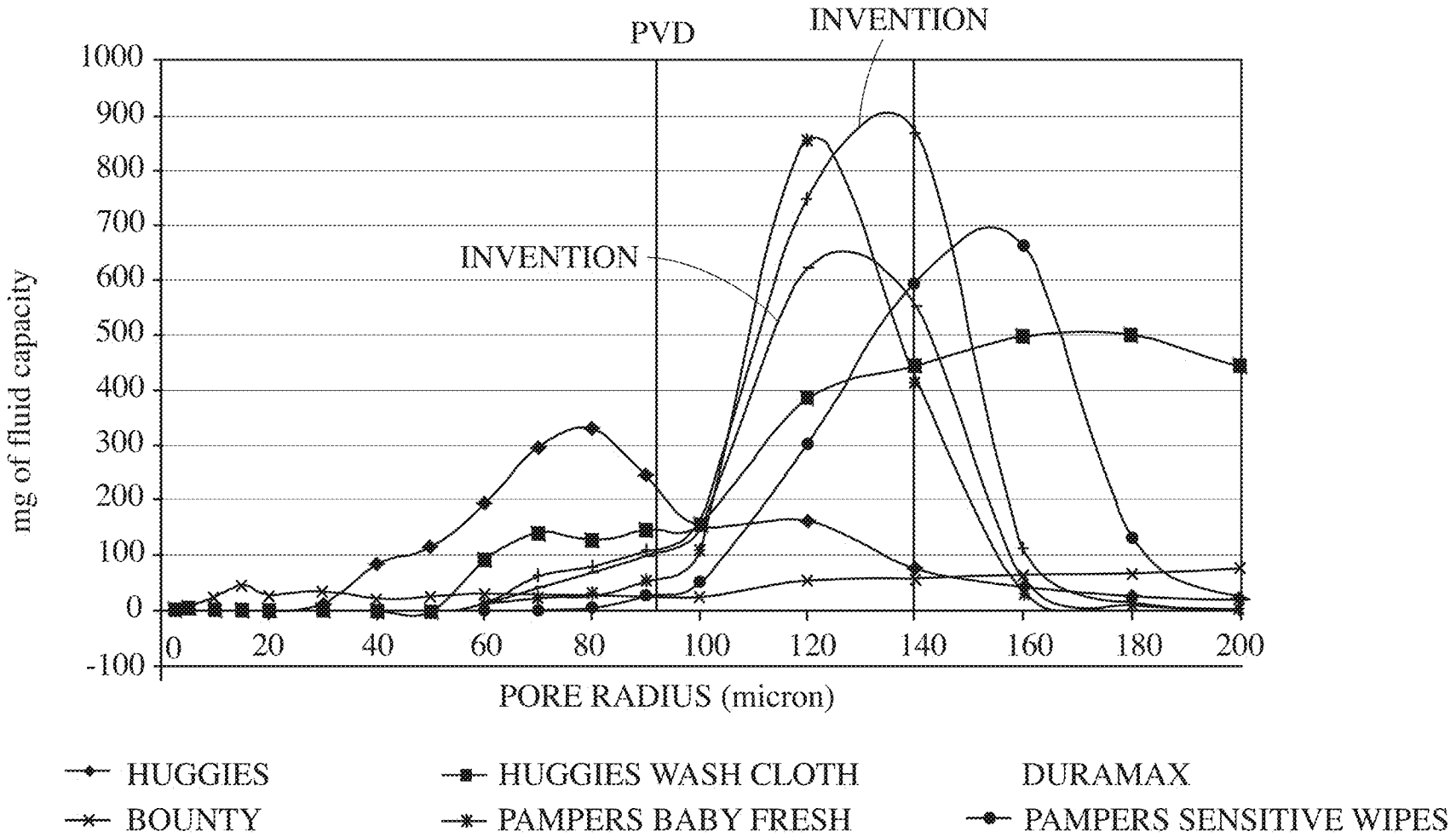
FIG. 2 is a Pore Volume Distribution graph of various fibrous structures, including a fibrous structure according to the present invention, showing the Ending Pore Radius of from 2.5 μm to 200 μm and the Capacity of Water in Pores.

FIG. 2 shows that the fibrous structures and/or wipes of the present invention exhibit novel pore volume distributions.

The fibrous structures of the present invention may comprise a plurality of filaments, a plurality of solid additives, such as fibers, and a mixture of filaments and solid additives.

Figure 3:
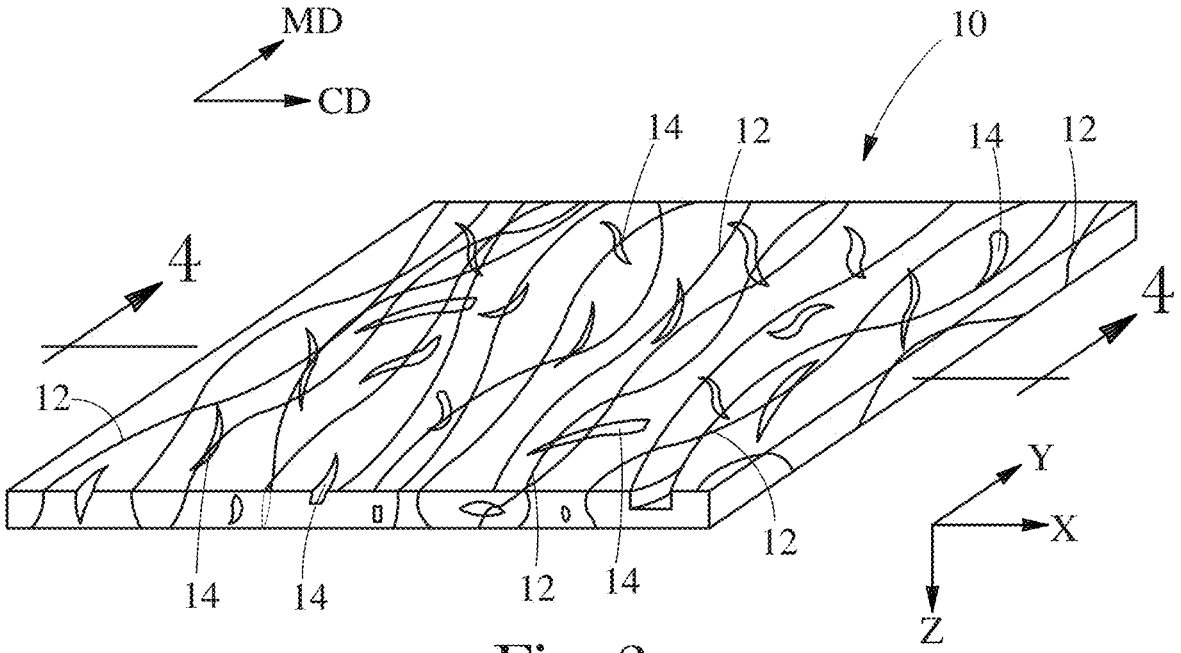
FIG. 3 is a schematic representation of an example of a fibrous structure according to the present invention.
Figure 4:
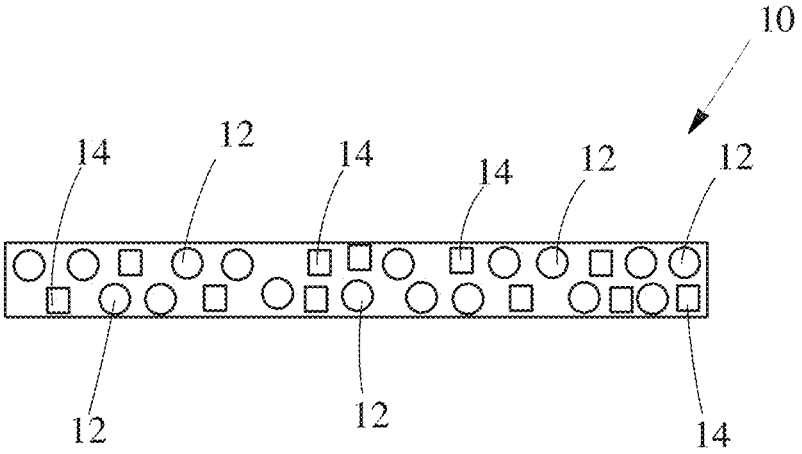
FIG. 4 is a schematic, cross-sectional representation of FIG. 3 taken along line 4-4.

FIGS. 3 and 4 show schematic representations of an example of a fibrous structure in accordance with the present invention. As shown in FIGS. 3 and 4, the fibrous structure 10 may be a co-formed fibrous structure. The fibrous structure 10 comprises a plurality of filaments 12, such as polypropylene filaments, and a plurality of solid additives, such as wood pulp fibers 14. The filaments 12 may be randomly arranged as a result of the process by which they are spun and/or formed into the fibrous structure 10. The wood pulp fibers 14, may be randomly dispersed throughout the fibrous structure 10 in the x-y plane. The wood pulp fibers 14 may be non-randomly dispersed throughout the fibrous structure in the z-direction. In one example (not shown), the wood pulp fibers 14 are present at a higher concentration on one or more of the exterior, x-y plane surfaces than within the fibrous structure along the z-direction.

Figure 5:
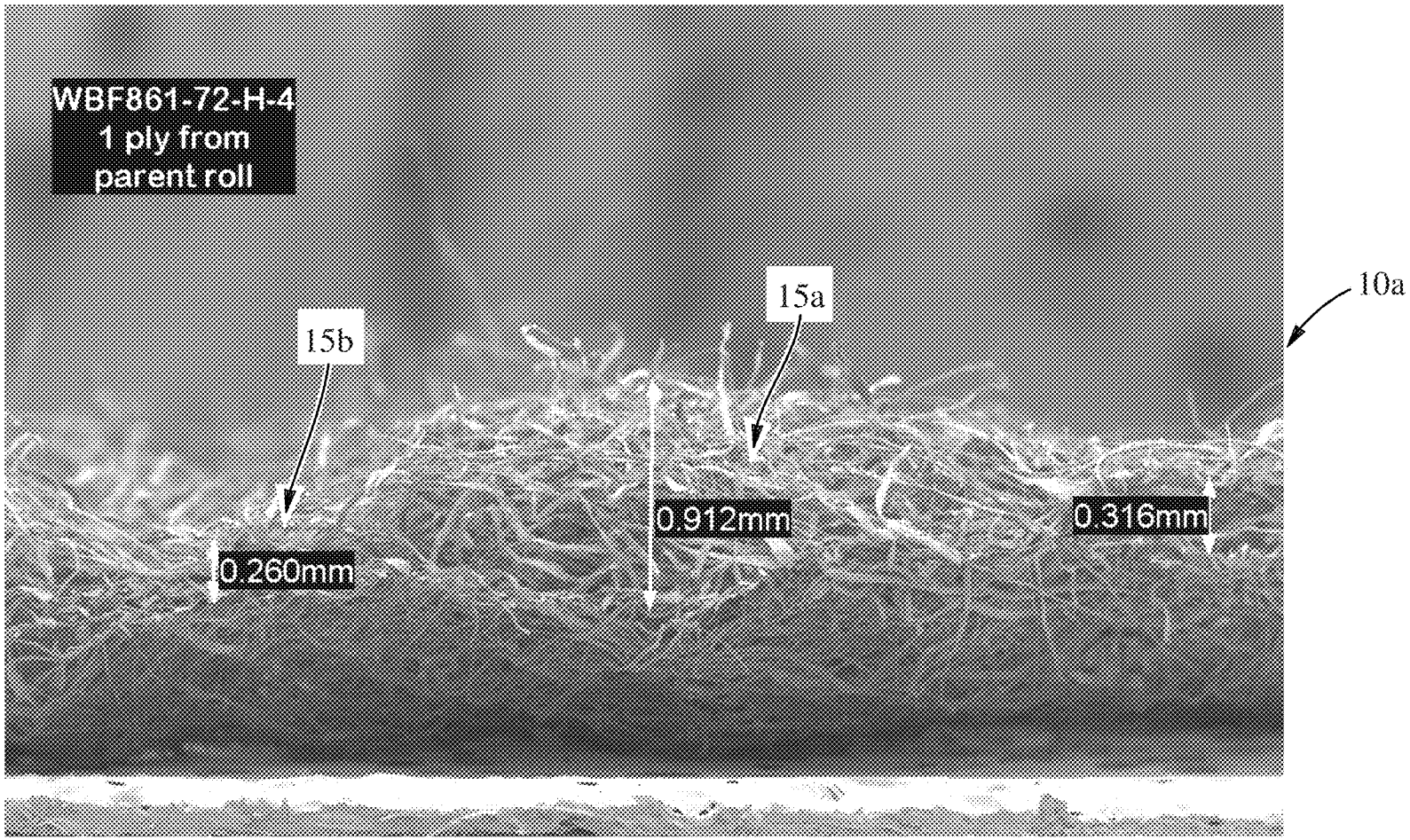
FIG. 5 is a scanning electromicrophotograph of a cross-section of another example of fibrous structure according to the present invention.

FIG. 5 shows a cross-sectional, SEM microphotograph of another example of a fibrous structure 10*a* in accordance with the present invention shows a fibrous structure 10*a* comprising a non-random, repeating pattern of microregions 15*a* and 15*b*. The microregion 15*a* (typically referred to as a "pillow") exhibits a different value of a common intensive property than microregion 15*b* (typically referred to as a "knuckle"). In one example, the microregion 15*b* is a continuous or semi-continuous network and the microregion 15*a* are discrete regions within the continuous or semi-continuous network. The common intensive property may be caliper. In another example, the common intensive property may be density.

Figure 6:
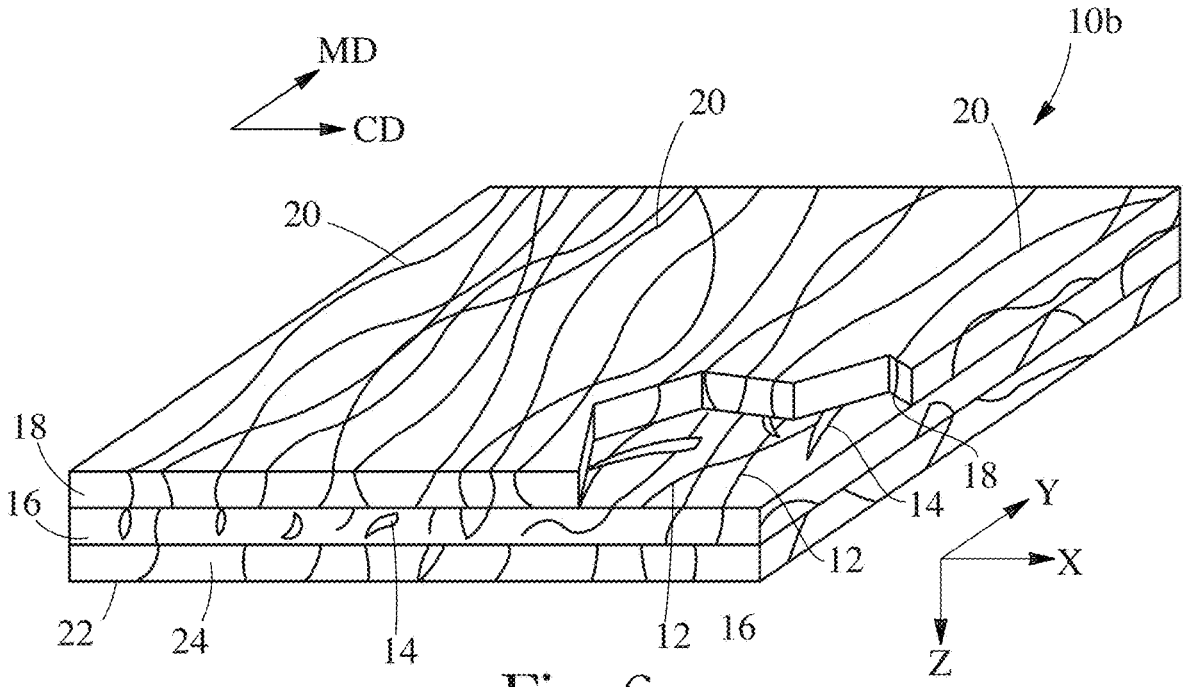
FIG. 6 is a schematic representation of another example of a fibrous structure according to the present invention.

As shown in FIG. 6, another example of a fibrous structure in accordance with the present invention is a layered fibrous structure 10*b*. The layered fibrous structure 10*b* comprises a first layer 16 comprising a plurality of filaments 12, such as polypropylene filaments, and a plurality of solid additives, in this example, wood pulp fibers 14. The layered fibrous structure 10*b* further comprises a second layer 18 comprising a plurality of filaments 20, such as polypropylene filaments. In one example, the first and second layers 16, 18, respectively, are sharply defined zones of concentration of the filaments and/or solid additives. The plurality of filaments 20 may be deposited directly onto a surface of the first layer 16 to form a layered fibrous structure that comprises the first and second layers 16, 18, respectively.

Further, the layered fibrous structure 10*b* may comprise a third layer 22, as shown in FIG. 6. The third layer 22 may comprise a plurality of filaments 24, which may be the same or different from the filaments 20 and/or 16 in the second 18 and/or first 16 layers. As a result of the addition of the third layer 22, the first layer 16 is positioned, for example sandwiched, between the second layer 18 and the third layer 22. The plurality of filaments 24 may be deposited directly onto a surface of the first layer 16, opposite from the second layer, to form the layered fibrous structure 10*b* that comprises the first, second and third layers 16, 18, 22, respectively.

Figure 7:
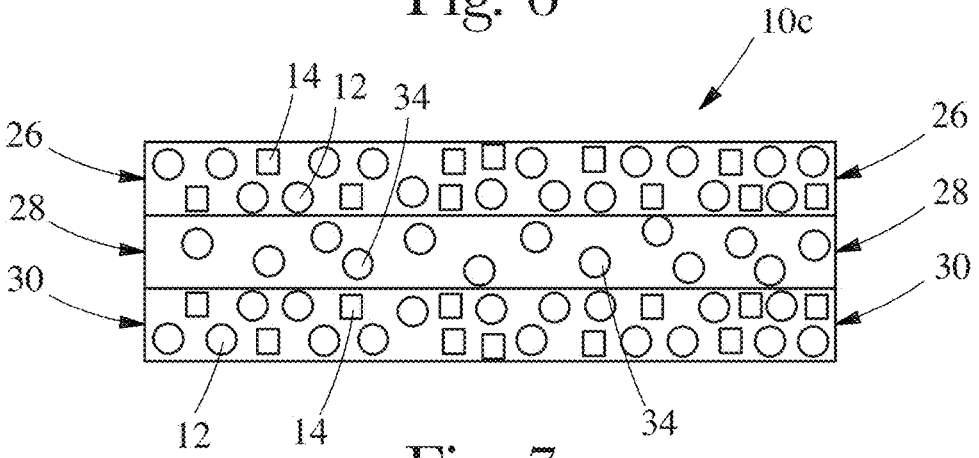
FIG. 7 is a schematic, cross-sectional representation of another example of a fibrous structure according to the present invention.

As shown in FIG. 7, a cross-sectional schematic representation of another example of a fibrous structure in accordance with the present invention comprising a layered fibrous structure 10*c* is provided. The layered fibrous structure 10*c* comprises a first layer 26, a second layer 28 and optionally a third layer 30. The first layer 26 comprises a plurality of filaments 12, such as polypropylene filaments, and a plurality of solid additives, such as wood pulp fibers 14. The second layer 28 may comprise any suitable filaments, solid additives and/or polymeric films. In one example, the second layer 28 comprises a plurality of filaments 34. In one example, the filaments 34 comprise a polymer selected from the group consisting of: polysaccharides, polysaccharide derivatives, polyvinylalcohol, polyvinylalcohol derivatives and mixtures thereof.

In yet another example, a fibrous structure of the present invention may comprise two outer layers consisting of 100% by weight filaments and an inner layer consisting of 100% by weight fibers.

In another example of a fibrous structure in accordance with the present invention, instead of being layers of fibrous structure 10*c*, the material forming layers 26, 28 and 30, may be in the form of plies wherein two or more of the plies may be combined to form a fibrous structure. The plies may be bonded together, such as by thermal bonding and/or adhesive bonding, to form a multi-ply fibrous structure.

Figure 8:
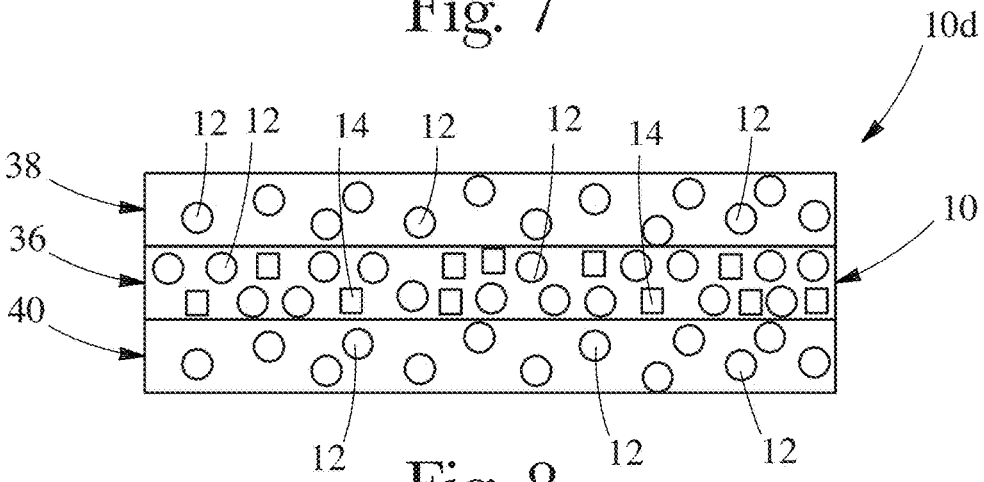
FIG. 8 is a schematic, cross-sectional representation of another example of a fibrous structure according to the present invention.

Another example of a fibrous structure of the present invention in accordance with the present invention is shown in FIG. 8. The fibrous structure 10*d* may comprise two or more plies, wherein one ply 36 comprises any suitable fibrous structure in accordance with the present invention, for example fibrous structure 10 as shown and described in FIGS. 3 and 4 and another ply 38 comprising any suitable fibrous structure, for example a fibrous structure comprising filaments 12, such as polypropylene filaments. The fibrous structure of ply 38 may be in the form of a net and/or mesh and/or other structure that comprises pores that expose one or more portions of the fibrous structure 10*d* to an external environment and/or at least to liquids that may come into contact, at least initially, with the fibrous structure of ply 38. In addition to ply 38, the fibrous structure 10*d* may further comprise ply 40. Ply 40 may comprise a fibrous structure comprising filaments 12, such as polypropylene filaments, and may be the same or different from the fibrous structure of ply 38.

Two or more of the plies 36, 38 and 40 may be bonded together, such as by thermal bonding and/or adhesive bonding, to form a multi-ply fibrous structure. After a bonding operation, especially a thermal bonding operation, it may be difficult to distinguish the plies of the fibrous structure 10*d* and the fibrous structure 10*d* may visually and/or physically be a similar to a layered fibrous structure in that one would have difficulty separating the once individual plies from each other. In one example, ply 36 may comprise a fibrous structure that exhibits a basis weight of at least about 15 $g/m^2$ and/or at least about 20 $g/m^2$ and/or at least about 25 $g/m^2$ and/or at least about 30 $g/m^2$ up to about 120 $g/m^2$ and/or 100 $g/m^2$ and/or 80 $g/m^2$ and/or 60 $g/m^2$ and the plies 38 and 42, when present, independently and individually, may comprise fibrous structures that exhibit basis weights of less than about 10 $g/m^2$ and/or less than about 7 $g/m^2$ and/or less than about 5 $g/m^2$ and/or less than about 3 $g/m^2$ and/or less than about 2 $g/m^2$ and/or to about 0 $g/m^2$ and/or 0.5 $g/m^2$.

Plies 38 and 40, when present, may help retain the solid additives, in this case the wood pulp fibers 14, on and/or within the fibrous structure of ply 36 thus reducing lint and/or dust (as compared to a single-ply fibrous structure comprising the fibrous structure of ply 36 without the plies 38 and 40) resulting from the wood pulp fibers 14 becoming free from the fibrous structure of ply 36.

The fibrous structures of the present invention may comprise any suitable amount of filaments and any suitable amount of solid additives. For example, the fibrous structures may comprise from about 10% to about 70% and/or from about 20% to about 60% and/or from about 30% to about 50% by dry weight of the fibrous structure of filaments and from about 90% to about 30% and/or from about 80% to about 40% and/or from about 70% to about 50% by dry weight of the fibrous structure of solid additives, such as wood pulp fibers. In one example, the fibrous structures of the present invention comprise filaments.

The filaments and solid additives of the present invention may be present in fibrous structures according to the present invention at weight ratios of filaments to solid additives of from at least about 1:1 and/or at least about 1:1.5 and/or at least about 1:2 and/or at least about 1:2.5 and/or at least about 1:3 and/or at least about 1:4 and/or at least about 1:5 and/or at least about 1:7 and/or at least about 1:10.

The fibrous structures of the present invention and/or any sanitary tissue products comprising such fibrous structures may be subjected to any post-processing operations such as embossing operations, printing operations, tuft-generating operations, thermal bonding operations, ultrasonic bonding operations, perforating operations, surface treatment operations such as application of lotions, silicones and/or other materials, folding, and mixtures thereof.

Non-limiting examples of suitable polypropylenes for making the filaments of the present invention are commercially available from Lyondell-Basell and Exxon-Mobil.

Any hydrophobic or non-hydrophilic materials within the fibrous structure, such as polypropylene filaments, may be surface treated and/or melt treated with a hydrophilic modifier. Non-limiting examples of surface treating hydrophilic modifiers include surfactants, such as Triton X-100. Non-limiting examples of melt treating hydrophilic modifiers that are added to the melt, such as the polypropylene melt, prior to spinning filaments, include hydrophilic modifying melt additives such as VW351 and/or S-1416 commercially available from Polyvel, Inc. and Irgasurf commercially available from Ciba. The hydrophilic modifier may be associated with the hydrophobic or non-hydrophilic material at any suitable level known in the art. In one example, the hydrophilic modifier is associated with the hydrophobic or non-hydrophilic material at a level of less than about 20% and/or less than about 15% and/or less than about 10% and/or less than about 5% and/or less than about 3% to about 0% by dry weight of the hydrophobic or non-hydrophilic material.

The fibrous structures of the present invention may include optional additives, each, when present, at individual levels of from about 0% and/or from about 0.01% and/or from about 0.1% and/or from about 1% and/or from about 2% to about 95% and/or to about 80% and/or to about 50% and/or to about 30% and/or to about 20% by dry weight of the fibrous structure. Non-limiting examples of optional additives include permanent wet strength agents, temporary wet strength agents, dry strength agents such as carboxymethylcellulose and/or starch, softening agents, lint reducing agents, opacity increasing agents, wetting agents, odor absorbing agents, perfumes, temperature indicating agents, color agents, dyes, osmotic materials, microbial growth detection agents, antibacterial agents and mixtures thereof.

The fibrous structure of the present invention may itself be a sanitary tissue product. It may be convolutedly wound about a core to form a roll. It may be combined with one or more other fibrous structures as a ply to form a multi-ply sanitary tissue product. In one example, a co-formed fibrous structure of the present invention may be convolutedly wound about a core to form a roll of co-formed sanitary tissue product. The rolls of sanitary tissue products may also be coreless.

The fibrous structures of the present invention may exhibit a Liquid Absorptive Capacity of at least 2.5 g/g and/or at least 4.0 g/g and/or at least 7 g/g and/or at least 12 g/g and/or at least 13 g/g and/or at least 13.5 g/g and/or to about 30.0 g/g and/or to about 20 g/g and/or to about 15.0 g/g as measured according to the Liquid Absorptive Capacity Test Method described herein.

Wipe

The fibrous structure, as described above, may be utilized to form a wipe. "Wipe" may be a general term to describe a piece of material, generally non-woven material, used in cleansing hard surfaces, food, inanimate objects, toys and body parts. In particular, many currently available wipes may be intended for the cleansing of the perianal area after defecation. Other wipes may be available for the cleansing of the face or other body parts. Multiple wipes may be attached together by any suitable method to form a mitt.

The material from which a wipe is made should be strong enough to resist tearing during normal use, yet still provide softness to the user's skin, such as a child's tender skin. Additionally, the material should be at least capable of retaining its form for the duration of the user's cleansing experience.

Wipes may be generally of sufficient dimension to allow for convenient handling. Typically, the wipe may be cut and/or folded to such dimensions as part of the manufacturing process. In some instances, the wipe may be cut into individual portions so as to provide separate wipes which are often stacked and interleaved in consumer packaging. In other embodiments, the wipes may be in a web form where the web has been slit and folded to a predetermined width and provided with means (e.g., perforations) to allow individual wipes to be separated from the web by a user. Suitably, an individual wipe may have a length between about 100 mm and about 250 mm and a width between about 140 mm and about 250 mm In one embodiment, the wipe may be about 200 mm long and about 180 mm wide and/or about 180 mm long and about 180 mm wide and/or about 170 mm long and about 180 mm wide and/or about 160 mm long and about 175 mm wide. The material of the wipe may generally be soft and flexible, potentially having a structured surface to enhance its cleaning performance.

It is also within the scope of the present invention that the wipe may be a laminate of two or more materials. Commercially available laminates, or purposely built laminates would be within the scope of the present invention. The laminated materials may be joined or bonded together in any suitable fashion, such as, but not limited to, ultrasonic bonding, adhesive, glue, fusion bonding, heat bonding, thermal bonding and combinations thereof. In another alternative embodiment of the present invention the wipe may be a laminate comprising one or more layers of nonwoven materials and one or more layers of film. Examples of such optional films, include, but are not limited to, polyolefin films, such as, polyethylene film. An illustrative, but non-limiting example of a nonwoven material which is a laminate is a laminate of a 16 gsm nonwoven polypropylene and a 0.8 mm 20 gsm polyethylene film.

The wipes may also be treated to improve the softness and texture thereof by processes such as hydroentanglement or spunlacing. The wipes may be subjected to various treatments, such as, but not limited to, physical treatment, such as ring rolling, as described in U.S. Pat. No. 5,143,679; structural elongation, as described in U.S. Pat. No. 5,518,801; consolidation, as described in U.S. Pat. Nos. 5,914,084, 6,114,263, 6,129,801 and 6,383,431; stretch aperturing, as described in U.S. Pat. Nos. 5,628,097, 5,658,639 and 5,916,661; differential elongation, as described in WO Publication No. 2003/0028165A1; and other solid state formation technologies as described in U.S. Publication No. 2004/0131820A1 and U.S. Publication No. 2004/0265534A1 and zone activation and the like; chemical treatment, such as, but not limited to, rendering part or all of the substrate hydrophobic, and/or hydrophilic, and the like; thermal treatment, such as, but not limited to, softening of fibers by heating, thermal bonding and the like; and combinations thereof.

The wipe may have a basis weight of at least about 30 grams/$m^2$ and/or at least about 35 grams/$m^2$ and/or at least about 40 grams/$m^2$. In one example, the wipe may have a basis weight of at least about 45 grams/$m^2$. In another example, the wipe basis weight may be less than about 100 grams/$m^2$. In another example, wipes may have a basis weight between about 45 grams/$m^2$ and about 75 grams/$m^2$, and in yet another embodiment a basis weight between about 45 grams/$m^2$ and about 65 grams/$m^2$.

In one example of the present invention the surface of wipe may be essentially flat. In another example of the present invention the surface of the wipe may optionally contain raised and/or lowered portions. These can be in the form of logos, indicia, trademarks, geometric patterns, images of the surfaces that the substrate is intended to clean (i.e., infant's body, face, etc.). They may be randomly arranged on the surface of the wipe or be in a repetitive pattern of some form.

In another example of the present invention the wipe may be biodegradable. For example the wipe could be made from a biodegradable material such as a polyesteramide, or high wet strength cellulose.

In one example of the present invention, the fibrous structure comprises a pre-moistened wipe, such as a baby wipe. A plurality of the pre-moistened wipes may be stacked one on top of the other and may be contained in a container, such as a plastic tub or a film wrapper. In one example, the stack of pre-moistened wipes (typically about 40 to 80 wipes/stack) may exhibit a height of from about 50 to about 300 mm and/or from about 75 to about 125 mm The pre-moistened wipes may comprise a liquid composition, such as a lotion. The pre-moistened wipes may be stored long term in a stack in a liquid impervious container or film pouch without all of the lotion draining from the top of the stack to the bottom of the stack. The pre-moistened wipes may exhibit a Liquid Absorptive Capacity of at least 2.5 g/g and/or at least 4.0 g/g and/or at least 7 g/g and/or at least 12 g/g and/or at least 13 g/g and/or at least 13.5 g/g and/or to about 30.0 g/g and/or to about 20 g/g and/or to about 15.0 g/g as measured according to the Liquid Absorptive Capacity Test Method described herein.

In another example, the pre-moistened wipes may exhibit a saturation loading (g liquid composition to g of dry wipe) of from about 1.5 to about 6.0 g/g. The liquid composition may exhibit a surface tension of from about 20 to about 35 and/or from about 28 to about 32 dynes/cm. The pre-moistened wipes may exhibit a dynamic absorption time (DAT) from about 0.01 to about 0.4 and/or from about 0.01 to about 0.2 and/or from about 0.03 to about 0.1 seconds as measured according to the Dynamic Absorption Time Test Method described herein.

In one example, the pre-moistened wipes are present in a stack of pre-moistened wipes that exhibits a height of from about 50 to about 300 mm and/or from about 75 to about 200 mm and/or from about 75 to about 125 mm, wherein the stack of pre-moistened wipes exhibits a saturation gradient index of from about 1.0 to about 2.0 and/or from about 1.0 to about 1.7 and/or from about 1.0 to about 1.5.

The fibrous structures or wipes of the present invention may be saturation loaded with a liquid composition to form a pre-moistened fibrous structure or wipe. The loading may occur individually, or after the fibrous structures or wipes are place in a stack, such as within a liquid impervious container or packet. In one example, the pre-moistened wipes may be saturation loaded with from about 1.5 g to about 6.0 g and/or from about 2.5 g to about 4.0 g of liquid composition per g of wipe.

The fibrous structures or wipes of the present invention may be placed in the interior of a container, which may be liquid impervious, such as a plastic tub or a sealable packet, for storage and eventual sale to the consumer. The wipes may be folded and stacked. The wipes of the present invention may be folded in any of various known folding patterns, such as C-folding, Z-folding and quarter-folding. Use of a Z-fold pattern may enable a folded stack of wipes to be interleaved with overlapping portions. Alternatively, the wipes may include a continuous strip of material which has perforations between each wipe and which may be arranged in a stack or wound into a roll for dispensing, one after the other, from a container, which may be liquid impervious.

The fibrous structures or wipes of the present invention may further comprise prints, which may provide aesthetic appeal. Non-limiting examples of prints include figures, patterns, letters, pictures and combinations thereof.

To further illustrate the fibrous structures of the present invention, Table 1 sets forth properties of known and/or commercially available fibrous structures and two fibrous structures in accordance with the present invention.

TABLE 1

| | Contains Filament | Basis Wt. [gsm] | Liquid Abs. Capacity [g/g] | Lotion Release (g) [g] | Soil Leak Through Lr Value | SGI | CD Wet Initial Tensile Strength [N/5 cm] | 43% or more of pores between 91 and 140 μm | 30% or more of pores between 121 and 200 μm |
|---|---|---|---|---|---|---|---|---|---|
| Invention | Yes | 61.1 | 13.6 | 0.279 | 1.0 | 1.21 | 8.7 | Yes | Yes |
| Invention | Yes | 44.1 | 14.8 | 0.333 | 1.7 | 1.11 | 6.6 | Yes | Yes |
| Invention | Yes | 65.0 | 16.0 | 0.355 | 0.9 | 1.21 | 6.0 | No | Yes |
| Huggies ® Natural Care | Yes | 64.0 | 11.5 | 0.277 | 0.0 | 1.05 | 5.1 | No | No |
| Huggies ® Natural Care | Yes | 62.5 | 9.78 | 0.268 | 0.0 | 1.34 | 3.8 | No | No |
| Bounty ® Paper Towel | No | 43.4 | 12.0 | — | 2.0 | — | — | No | No |
| Pampers ® Baby Fresh | No | 57.4 | 12.0 | 0.281 | 19.2 | <1.5 | 12.5 | Yes | No |
| Pampers ® Baby Fresh | No | 57.7 | 7.32 | 0.258 | 8.7 | 1.20 | 11.3 | No | Yes |
| Pampers ® Thickcare | No | 67.1 | 7.52 | 0.285 | 4.3 | 1.32 | 8.2 | No | No |

Table 2 sets forth the average pore volume distributions of known and/or commercially available fibrous structures and a fibrous structure in accordance with the present invention.

TABLE 2

| Pore Radius (micron) | Huggies ® | Huggies ® Wash Cloth | Duramax | Bounty ® (no filaments) | Pampers ® Baby Fresh (no filaments) | Pampers ® Sensitive Wipes (no filaments) | Invention | Invention |
|---|---|---|---|---|---|---|---|---|
| 2.5 | 0 | 0 | 0 | 0 | 0 | 0 | 0 | 0 |
| 5 | 0 | 3.65 | 5.4 | 5.15 | 3.65 | 2.85 | 4.15 | 3.1 |
| 10 | 3.05 | 3.95 | 19.85 | 24.15 | 1.25 | 0.85 | 1.3 | 0.6 |
| 15 | 1.85 | 0.95 | 95.6 | 46.2 | 0 | 0 | 0 | 0 |
| 20 | 0 | 0 | 53.95 | 27.95 | 0 | 0 | 0 | 0 |
| 30 | 13.65 | 0 | 73.85 | 36.3 | 0 | 0 | 0 | 0 |
| 40 | 85.45 | 0 | 57.15 | 22.85 | 0 | 0 | 0 | 0 |
| 50 | 116.95 | 0 | 61.25 | 27.5 | 0 | 0 | 0 | 0 |
| 60 | 196.5 | 92.95 | 66.9 | 35.3 | 12.75 | 1.2 | 17.15 | 16.45 |
| 70 | 299.15 | 141.55 | 58.35 | 33 | 25.55 | 3.05 | 65.75 | 44.7 |
| 80 | 333.8 | 129.25 | 52.95 | 30.8 | 32.45 | 7 | 83.2 | 72.4 |
| 90 | 248.15 | 148.05 | 46.55 | 30.25 | 56.7 | 30.75 | 111.65 | 104.8 |
| 100 | 157.55 | 160.2 | 45.7 | 29.6 | 112.7 | 56.1 | 169.4 | 152.8 |
| 120 | 168.05 | 389.35 | 90.85 | 59.95 | 858.65 | 306.15 | 751.65 | 626.85 |
| 140 | 81.6 | 448.2 | 86 | 65 | 427.05 | 600.4 | 873.85 | 556.95 |
| 160 | 50.6 | 502.05 | 73.2 | 71.4 | 40.25 | 666.05 | 119.3 | 64.65 |
| 180 | 34.05 | 506.45 | 60.2 | 75.25 | 18.3 | 137.9 | 20.15 | 16.95 |
| 200 | 27.2 | 448 | 47.05 | 86.25 | 10.5 | 31.95 | 14.7 | 11.9 |
| 225 | 23.9 | 404.85 | 47.3 | 130.1 | 8.8 | 14.1 | 15.15 | 12.45 |
| 250 | 19.85 | 242.2 | 41 | 146.8 | 10.3 | 10.65 | 14.8 | 12.35 |
| 275 | 18.05 | 140 | 36.15 | 153.8 | 6.15 | 7.25 | 12.1 | 10.2 |
| 300 | 15.7 | 98.6 | 33.25 | 123 | 5.85 | 6.2 | 13.65 | 9.55 |
| 350 | 22.9 | 146.15 | 53.65 | 137.95 | 9.6 | 10.1 | 21.15 | 16.2 |
| 400 | 17.8 | 135.25 | 52.8 | 45.95 | 8.9 | 8.45 | 17.6 | 19.15 |
| 500 | 33.5 | 259.05 | 254.35 | 43.9 | 14.55 | 13.5 | 38.1 | 33.65 |
| 600 | 21.85 | 218.5 | 279.45 | 11.45 | 14.45 | 12.7 | 56.85 | 23 |
| 800 | 20.05 | 235 | 135.8 | 8.3 | 61.45 | 108 | 59.05 | 33.05 |
| 1000 | 9.2 | 83 | 0 | 0 | 23.25 | 36.75 | 47.95 | 52.95 |
| Total (mg) | 2020.4 | 4937.2 | 1928.55 | 1508.15 | 1763.1 | 2071.95 | 2528.65 | 1894.7 |
| 91-140 | 20.2% | 20.2% | 11.5% | 10.2% | 79.3% | 46.5% | 71.0% | 70.5% |

TABLE 2-continued

| | | | | | | | | |
|---|---|---|---|---|---|---|---|---|
| Pore Range 101-200 | 18% | 46% | 19% | 24% | 77% | 84% | 70% | 67% |
| Pore Range 121-200 | 10% | 39% | 14% | 20% | 28% | 69% | 41% | 34% |
| Pore Range 141-225 | 7% | 38% | 12% | 24% | 4% | 41% | 7% | 6% |
| Pore Range | | | | | | | | |

| Pore Radius (micron) | Huggies ® | Pampers ® Thickcare (no filaments) | Pampers ® Baby Fresh (no filaments) | Invention |
|---|---|---|---|---|
| 2.5 | 0 | 0 | 0 | 0 |
| 5 | 5.1 | 5.2 | 4.5 | 5.5 |
| 10 | 3.3 | 3.3 | 2.2 | 2.6 |
| 15 | 2 | 2.4 | 0.8 | 2 |
| 20 | 2.1 | 1.2 | 2 | 0.7 |
| 30 | 8.5 | 12.3 | 0.8 | 1.7 |
| 40 | 39.6 | 43.3 | 4.3 | 3.3 |
| 50 | 98.3 | 83.6 | 2.5 | 0.7 |
| 60 | 70.2 | 107.3 | 2.8 | 2.1 |
| 70 | 118.2 | 174.2 | 6 | 1.4 |
| 80 | 156.9 | 262.4 | 19.5 | 1.9 |
| 90 | 255.3 | 297.4 | 9.8 | 1.8 |
| 100 | 342.1 | 188.7 | 17 | 7.5 |
| 120 | 396.3 | 168.8 | 38.4 | 80.4 |
| 140 | 138.3 | 55.9 | 69.7 | 306.9 |
| 160 | 70.5 | 22.8 | 133.1 | 736 |
| 180 | 45.8 | 16.7 | 448.1 | 1201.1 |
| 200 | 28.3 | 13.8 | 314.2 | 413 |
| 225 | 31.9 | 16.5 | 362.2 | 131.5 |
| 250 | 30.5 | 11.7 | 206.6 | 55.6 |
| 275 | 26.4 | 11.9 | 138.3 | 24.9 |
| 300 | 23.8 | 11.9 | 78.7 | 13.6 |
| 350 | 37.4 | 18.9 | 77.1 | 23.3 |
| 400 | 28.5 | 16.5 | 37.6 | 20 |
| 500 | 44.2 | 24.2 | 37.9 | 30.3 |
| 600 | 27.6 | 28.8 | 32.6 | 24.5 |
| 800 | 41.1 | 66.5 | 35.3 | 39.5 |
| 1000 | 24.7 | 32 | 16.3 | 27.9 |
| Total (mg) | 2096.9 | 1698.2 | 2098.3 | 3159.7 |
| 91-140 | 41.8% | 24.3% | 6.0% | 12.5% |
| Pore Range 101-200 | 32% | 16% | 48% | 87% |
| Pore Range 121-200 | 13% | 6% | 46% | 84% |
| Pore Range 141-225 | 8% | 4% | 60% | 79% |
| Pore Range | | | | |

Method for Making A Fibrous Structure

Figure 9:
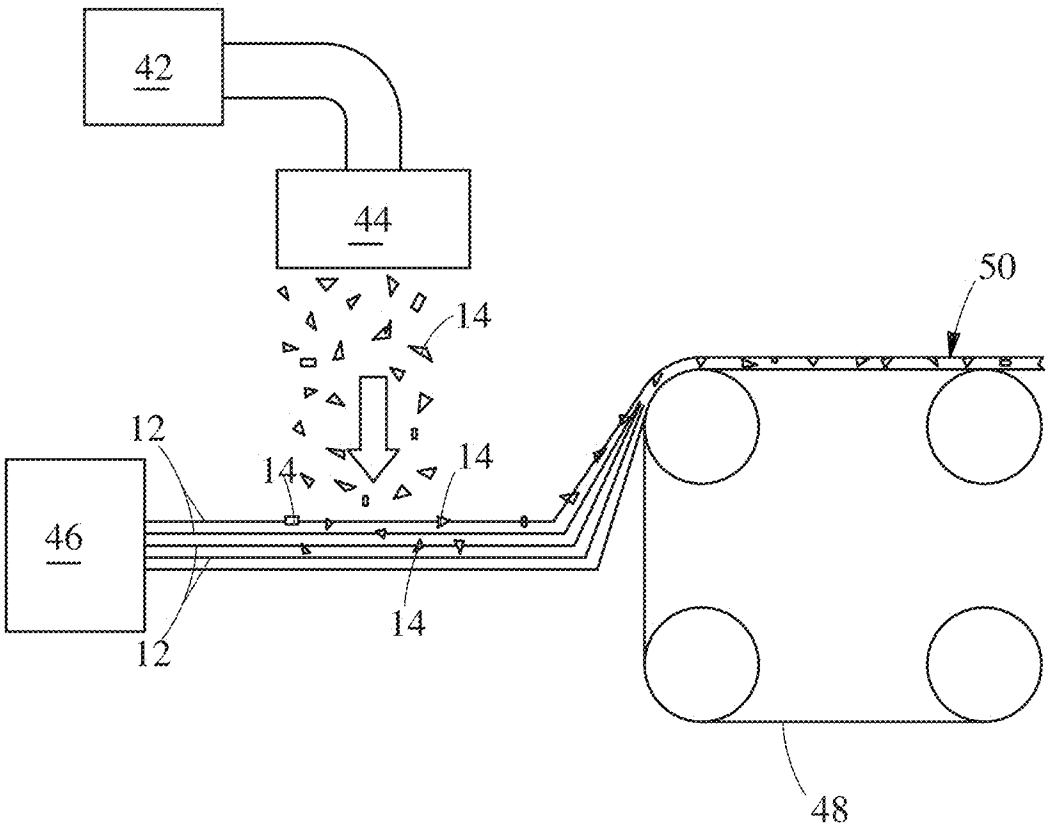
FIG. 9 is a schematic representation of an example of a process for making a fibrous structure according to the present invention.
Figure 10:
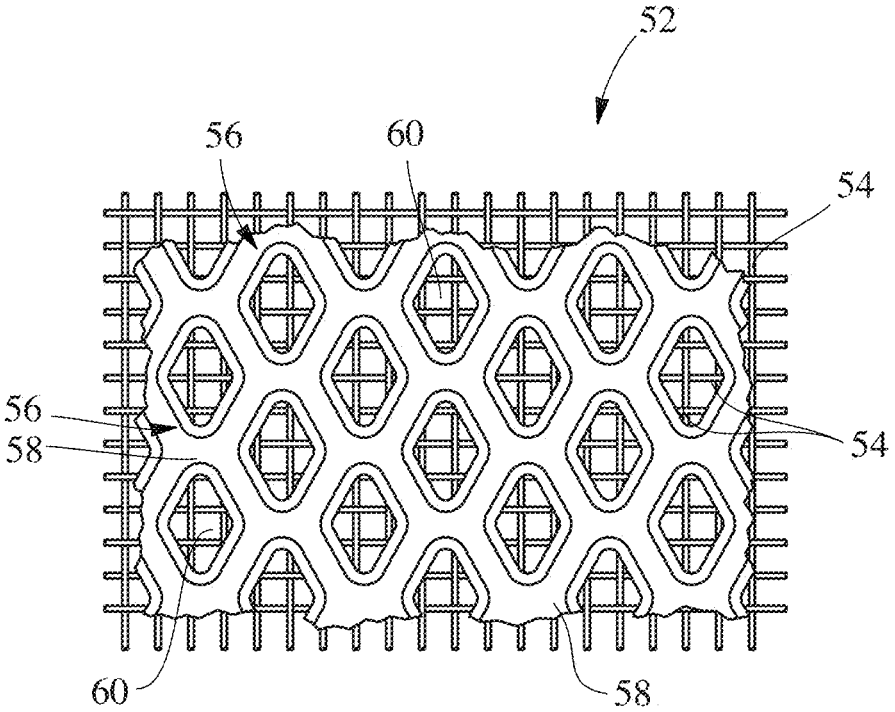
FIG. 10 is a schematic representation of an example of a patterned belt for use in a process according to the present invention.

A non-limiting example of a method for making a fibrous structure according to the present invention is represented in FIG. 9. The method shown in FIG. 9 comprises the step of mixing a plurality of solid additives 14 with a plurality of filaments 12. In one example, the solid additives 14 are wood pulp fibers, such as SSK fibers and/or Eucalytpus fibers, and the filaments 12 are polypropylene filaments. The solid additives 14 may be combined with the filaments 12, such as by being delivered to a stream of filaments 12 from a hammermill 42 via a solid additive spreader 44 to form a mixture of filaments 12 and solid additives 14. The filaments 12 may be created by meltblowing from a meltblow die 46. The mixture of solid additives 14 and filaments 12 are collected on a collection device, such as a belt 48 to form a fibrous structure 50. The collection device may be a patterned and/or molded belt that results in the fibrous structure exhibiting a surface pattern, such as a non-random, repeating pattern of microregions. The molded belt may have a three-dimensional pattern on it that gets imparted to the fibrous structure 50 during the process. For example, the patterned belt 52, as shown in FIG. 10, may comprise a reinforcing structure, such as a fabric 54, upon which a polymer resin 56 is applied in a pattern. The pattern may comprise a continuous or semi-continuous network 58 of the polymer resin 56 within which one or more discrete conduits 60 are arranged.

In one example of the present invention, the fibrous structures are made using a die comprising at least one filament-forming hole, and/or 2 or more and/or 3 or more rows of filament-forming holes from which filaments are spun. At least one row of holes contains 2 or more and/or 3 or more and/or 10 or more filament-forming holes. In addition to the filament-forming holes, the die comprises fluid-releasing holes, such as gas-releasing holes, in one example air-releasing holes, that provide attenuation to the filaments formed from the filament-forming holes. One or more fluid-releasing holes may be associated with a filament-forming hole such that the fluid exiting the fluid-releasing hole is parallel or substantially parallel (rather than angled like a knife-edge die) to an exterior surface of a filament exiting the filament-forming hole. In one example, the fluid exiting the fluid-releasing hole contacts the exterior surface of a filament formed from a filament-forming hole at an angle of less than 30° and/or less than 20° and/or less than 10° and/or less than 5° and/or about 0°. One or more fluid releasing holes may be arranged around a filament-forming hole. In one example, one or more fluid-releasing holes are associated with a single filament-forming hole such that the fluid exiting the one or more fluid releasing holes contacts the exterior surface of a single filament formed from the single filament-forming hole. In one example, the fluid-releasing hole permits a fluid, such as a gas, for example air, to contact the exterior surface of a filament formed from a filament-forming hole rather than contacting an inner surface of a filament, such as what happens when a hollow filament is formed.

Figure 11:
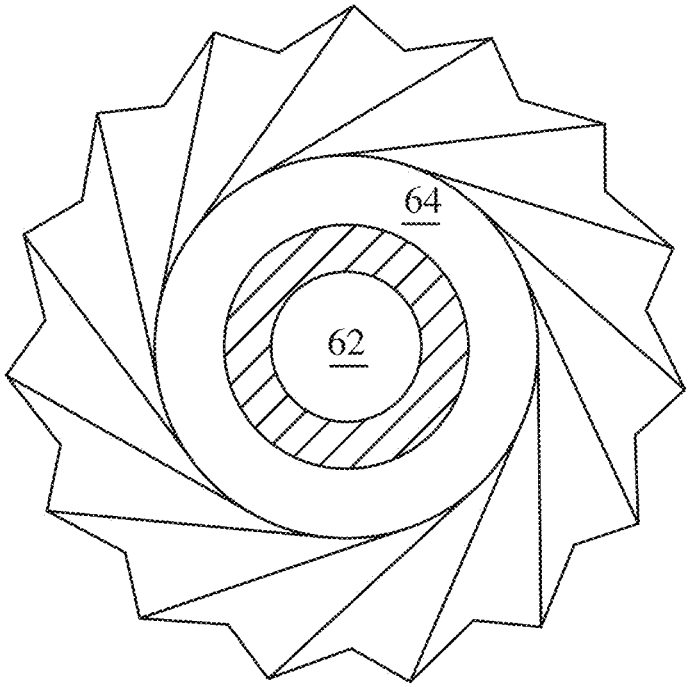
FIG. 11 is a schematic representation of an example of a filament-forming hole and fluid-releasing hole from a suitable die useful in making a fibrous structure according to the present invention.

In one example, the die comprises a filament-forming hole positioned within a fluid-releasing hole. The fluid-releasing hole 62 may be concentrically or substantially concentrically positioned around a filament-forming hole 64 such as is shown in FIG. 11.

After the fibrous structure 50 has been formed on the collection device, such as a patterned belt or a woven fabric for example a through-air-drying fabric, the fibrous structure 50 may be calendered, for example, while the fibrous structure is still on the collection device. In addition, the fibrous structure 50 may be subjected to post-processing operations such as embossing, thermal bonding, tuft-generating operations, moisture-imparting operations, and surface treating operations to form a finished fibrous structure. One example of a surface treating operation that the fibrous structure may be subjected to is the surface application of an elastomeric binder, such as ethylene vinyl acetate (EVA), latexes, and other elastomeric binders. Such an elastomeric binder may aid in reducing the lint created from the fibrous structure during use by consumers. The elastomeric binder may be applied to one or more surfaces of the fibrous structure in a pattern, especially a non-random, repeating pattern of microregions, or in a manner that covers or substantially covers the entire surface(s) of the fibrous structure.

In one example, the fibrous structure 50 and/or the finished fibrous structure may be combined with one or more other fibrous structures. For example, another fibrous structure, such as a filament-containing fibrous structure, such as a polypropylene filament fibrous structure may be associated with a surface of the fibrous structure 50 and/or the finished fibrous structure. The polypropylene filament fibrous structure may be formed by meltblowing polypropylene filaments (filaments that comprise a second polymer that may be the same or different from the polymer of the filaments in the fibrous structure 50) onto a surface of the fibrous structure 50 and/or finished fibrous structure. In another example, the polypropylene filament fibrous structure may be formed by meltblowing filaments comprising a second polymer that may be the same or different from the polymer of the filaments in the fibrous structure 50 onto a collection device to form the polypropylene filament fibrous structure. The polypropylene filament fibrous structure may then be combined with the fibrous structure 50 or the finished fibrous structure to make a two-ply fibrous structure—three-ply if the fibrous structure 50 or the finished fibrous structure is positioned between two plies of the polypropylene filament fibrous structure like that shown in FIG. 6 for example. The polypropylene filament fibrous structure may be thermally bonded to the fibrous structure 50 or the finished fibrous structure via a thermal bonding operation.

In yet another example, the fibrous structure 50 and/or finished fibrous structure may be combined with a filament-containing fibrous structure such that the filament-containing fibrous structure, such as a polysaccharide filament fibrous structure, such as a starch filament fibrous structure, is positioned between two fibrous structures 50 or two finished fibrous structures like that shown in FIG. 8 for example.

In one example of the present invention, the method for making a fibrous structure according to the present invention comprises the step of combining a plurality of filaments and optionally, a plurality of solid additives to form a fibrous structure that exhibits the properties of the fibrous structures of the present invention described herein. In one example, the filaments comprise thermoplastic filaments. In one example, the filaments comprise polypropylene filaments. In still another example, the filaments comprise natural polymer filaments. The method may further comprise subjecting the fibrous structure to one or more processing operations, such as calendaring the fibrous structure. In yet another example, the method further comprises the step of depositing the filaments onto a patterned belt that creates a non-random, repeating pattern of micro regions.

In still another example, two plies of fibrous structure 50 comprising a non-random, repeating pattern of microregions may be associated with one another such that protruding microregions, such as pillows, face inward into the two-ply fibrous structure formed.

The process for making fibrous structure 50 may be close coupled (where the fibrous structure is convolutedly wound into a roll prior to proceeding to a converting operation) or directly coupled (where the fibrous structure is not convolutedly wound into a roll prior to proceeding to a converting operation) with a converting operation to emboss, print, deform, surface treat, thermal bond, cut, stack or other post-forming operation known to those in the art. For purposes of the present invention, direct coupling means that the fibrous structure 50 can proceed directly into a converting operation rather than, for example, being convolutedly wound into a roll and then unwound to proceed through a converting operation.

In one example, the fibrous structure is embossed, cut into sheets, and collected in stacks of fibrous structures.

The process of the present invention may include preparing individual rolls and/or sheets and/or stacks of sheets of fibrous structure and/or sanitary tissue product comprising such fibrous structure(s) that are suitable for consumer use.

Non-Limiting Examples of Processes for Making a Fibrous Structure of the Present Invention:

Process Example 1

A 20%:27.5%47.5%:5% blend of Lyondell-Basell PH835 polypropylene : Lyondell-Basell Metocene MF650W polypropylene : Exxon-Mobil PP3546 polypropylene : Polyvel S-1416 wetting agent is dry blended, to form a melt blend. The melt blend is heated to 475° F. through a melt extruder. A 15.5 inch wide Biax 12 row spinnerette with 192 nozzles per cross-direction inch, commercially available from Biax Fiberfilm Corporation, is utilized. 40 nozzles per cross-direction inch of the 192 nozzles have a 0.018 inch inside diameter while the remaining nozzles are solid, i.e. there is no opening in the nozzle. Approximately 0.19 grams per hole per minute (ghm) of the melt blend is extruded from the open nozzles to form meltblown filaments from the melt blend. Approximately 375 SCFM of compressed air is heated such that the air exhibits a temperature of about 395° F. at the spinnerette. Approximately 475 g/minute of Golden Isle (from Georgia Pacific) 4825 semi-treated SSK pulp is defibrillated through a hammermill to form SSK wood pulp fibers (solid additive). Air at a temperature of about 85 to 90° F. and about 85% relative humidity (RH) is drawn into the hammermill. Approximately 1200 SCFM of air carries the pulp fibers to a solid additive spreader. The solid additive spreader turns the pulp fibers and distributes the pulp fibers in the cross-direction such that the pulp fibers are injected into the meltblown filaments in a perpendicular fashion (with respect to the flow of the meltblown filaments) through a 4 inch×15 inch cross-direction (CD) slot. A forming box surrounds the area where the meltblown filaments and pulp fibers are commingled. This forming box is designed to reduce the amount of air allowed to enter or escape from this commingling area; however, there is an additional 4 inch×15 inch spreader opposite the solid additive spreader designed to add cooling air. Approximately 1000 SCFM of air at approximately 80° F. is added through this additional spreader. A forming vacuum pulls air through a collection device, such as a patterned belt, thus collecting the commingled meltblown filaments and pulp fibers to form a fibrous structure comprising a pattern of non-random, repeating microregions. The fibrous structure formed by this process comprises about 75% by dry fibrous structure weight of pulp and about 25% by dry fibrous structure weight of meltblown filaments.

Optionally, a meltblown layer of the meltblown filaments, such as a scrim, can be added to one or both sides of the above formed fibrous structure. This addition of the meltblown layer can help reduce the lint created from the fibrous structure during use by consumers and is preferably performed prior to any thermal bonding operation of the fibrous structure. The meltblown filaments for the exterior layers can be the same or different than the meltblown filaments used on the opposite layer or in the center layer(s).

The fibrous structure may be convolutedly wound to form a roll of fibrous structure. The end edges of the roll of fibrous structure may be contacted with a material to create bond regions.

Process Example 2

A 20%:27.5%47.5%:5% blend of Lyondell-Basell PH835 polypropylene:Lyondell-Basell Metocene MF650W polypropylene:Exxon-Mobil PP3546 polypropylene:Polyvel S-1416 wetting agent is dry blended, to form a melt blend. The melt blend is heated to about 405° F. through a melt extruder. A 15.5 inch wide Biax 12 row spinnerette with 192 nozzles per cross-direction inch, commercially available from Biax Fiberfilm Corporation, is utilized. 64 nozzles per cross-direction inch of the 192 nozzles have a 0.018 inch inside diameter while the remaining nozzles are solid, i.e. there is no opening in the nozzle. Approximately 0.21 grams per hole per minute (ghm) of the melt blend is extruded from the open nozzles to form meltblown filaments from the melt blend. Approximately 500 SCFM of compressed air is heated such that the air exhibits a temperature of about 395° F. at the spinnerette. Approximately 1000 g/minute of Golden Isle (from Georgia Pacific) 4825 semi-treated SSK pulp is defibrillated through a hammermill to form SSK wood pulp fibers (solid additive). Air at a temperature of about 90° F. and about 75% relative humidity (RH) is drawn into the hammermill. Approximately 2000 SCFM of air carries the pulp fibers to two solid additive spreaders. The solid additive spreaders turns the pulp fibers and distributes the pulp fibers in the cross-direction such that the pulp fibers are injected into the meltblown filaments in a perpendicular fashion (with respect to the flow of the filaments) through two 4 inch×15 inch cross-direction (CD) slots. A forming box surrounds the area where the meltblown filaments and pulp fibers are commingled. This forming box is designed to reduce the amount of air allowed to enter or escape from this commingling area. The two slots are oriented opposite of one another on opposite sides of the meltblown filament spinnerette. A forming vacuum pulls air through a collection device, such as a non-patterned forming belt or through-air-drying fabric, thus collecting the commingled meltblown filaments and pulp fibers to form a fibrous structure. The fibrous structure formed by this process comprises about 80% by dry fibrous structure weight of pulp and about 20% by dry fibrous structure weight of meltblown filaments.

Optionally, a meltblown layer of the meltblown filaments, such as a scrim, can be added to one or both sides of the above formed fibrous structure. This addition of the meltblown layer can help reduce the lint created from the fibrous structure during use by consumers and is preferably performed prior to any thermal bonding operation of the fibrous structure. The meltblown filaments for the exterior layers can be the same or different than the meltblown filaments used on the opposite layer or in the center layer(s).

The fibrous structure may be convolutedly wound to form a roll of fibrous structure. The end edges of the roll of fibrous structure may be contacted with a material to create bond regions.

Non-Limiting Examples of Fibrous Structures

Fibrous Structure Example 1

Figure 12:
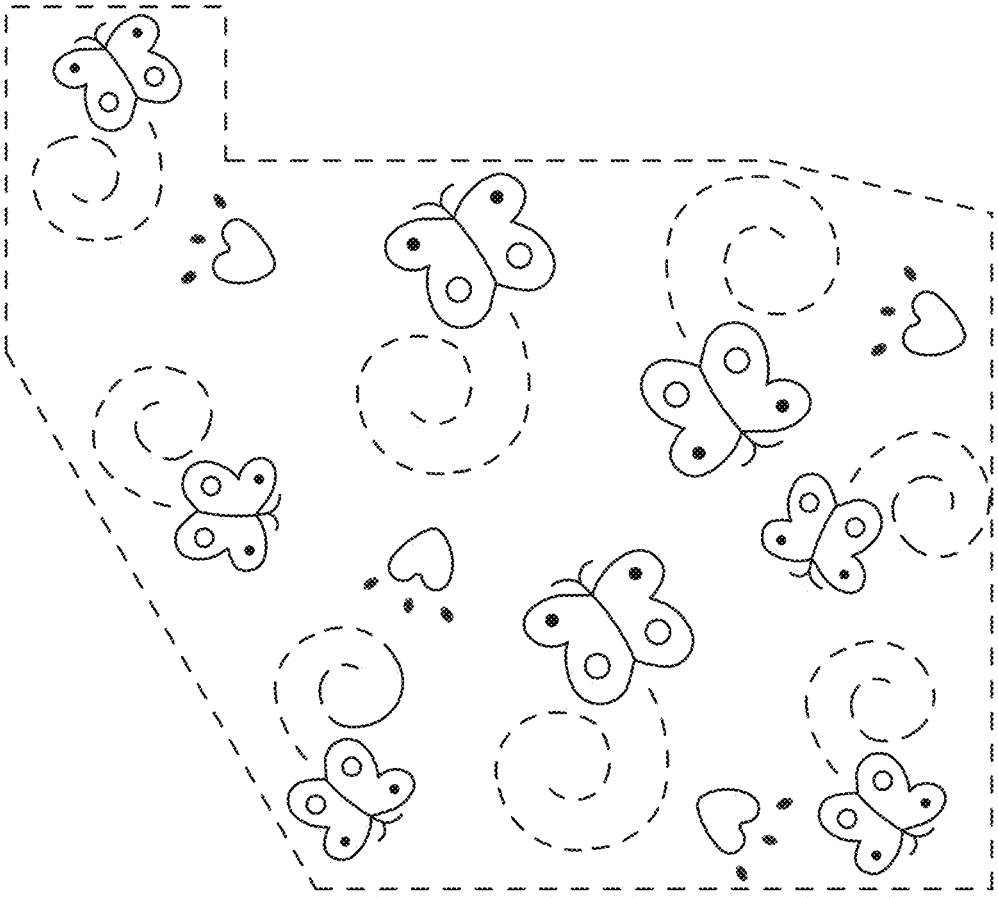
FIG. 12 is an example of a pattern that can be imparted to a fibrous structure of the present invention.
Figure 13:
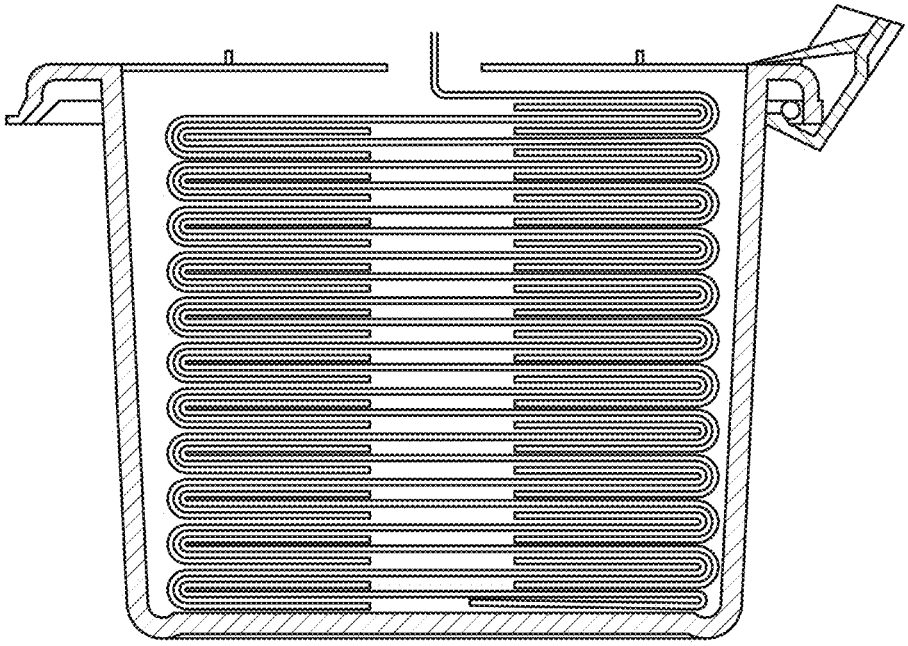
FIG. 13 is a schematic representation of an example of a stack of fibrous structures in a tub.

A pre-moistened wipe according to the present invention is prepared as follows. A fibrous structure of the present invention of about 44 g/m$^2$ that comprises a thermal bonded pattern as shown in FIG. 12 is saturation loaded with a liquid composition according to the present invention to an average saturation loading of about 358% of the basis weight of the wipe. The wipes are then Z-folded and placed in a stack to a height of about 82 mm as shown in FIG. 13.

Fibrous Structure Example 2

A pre-moistened wipe according to the present invention is prepared as follows. A fibrous structure of the present invention of about 61 g/m$^2$ that comprises a thermal bonded pattern as shown in FIG. 12 is saturation loaded with a liquid composition according to the present invention to an average saturation loading of about 347% of the basis weight of the wipe. The wipes are then Z-folded and placed in a stack to a height of about 82 mm as shown in FIG. 13.

Fibrous Structure Example 3

A pre-moistened wipe according to the present invention is prepared as follows. A fibrous structure of the present invention generally made as described above in the second non-limiting process example exhibits a basis weight of about 65 g/m$^2$ and comprises a thermal bond pattern as shown in FIG. 12 is saturation loaded with a liquid composition according to the present invention to an average saturation loading of about 347% of the basis weight of the wipe. The wipes are then Z-folded and placed in a stack to a height of about 82 mm as shown in FIG. 13.

TEST METHODS

Unless otherwise indicated, all tests described herein including those described under the Definitions section and the following test methods are conducted on samples that have been conditioned in a conditioned room at a temperature of 23° C.±2.2° C. and a relative humidity of 50%±10% for 24 hours prior to the test. All tests are conducted in such conditioned room.

For the dry test methods described herein (Liquid Absorptive Capacity, Pore Volume Distribution, Basis Weight, and Dynamic Absorption Time), if the fibrous structure or wipe comprises a liquid composition such that the fibrous structure or wipe exhibits a moisture level of about 100% or greater by weight of the fibrous structure or wipe, then the following pre-conditioning procedure needs to be performed on the fibrous structure or wipe before testing. If the fibrous structure or wipe comprises a liquid composition such that the fibrous structure or wipe exhibits a moisture level of less than about 100% by weight but greater than about 10% by weight of the fibrous structure or wipe, dry the fibrous structure or wipe in an oven at 85° C. until the fibrous structure or wipe contains less than 3% moisture by weight of the fibrous structure or wipe prior to completing the dry test methods.

To pre-condition a fibrous structure or wipe comprising a moisture level of about 100% or greater by weight of the fibrous structure or wipe use the following procedure. Fully saturate the fibrous structure or wipe by immersing the fibrous structure or wipe sequentially in 2 L of fresh distilled water in each of 5 buckets, where the water is at a temperature of 23° C.±2.2° C. Gently, agitate the fibrous structure or wipe in the water by moving the fibrous structure or wipe from one side of each bucket to the other at least 5 times, but no more than 10 times for 20 seconds in each of the 5 buckets. Remove the fibrous structure or wipe and then place horizontally in an oven at 85° C. until the fibrous structure or wipe contains less than 3% moisture by weight of the fibrous structure or wipe. After the fibrous structure or wipe exhibits less than 3% moisture, remove from the oven and allow the fibrous structure or wipe to equilibrate to about 23° C.±2.2° C. and a relative humidity of 50%±10% for 24 hours prior to the testing. Care needs to be taken to ensure that the fibrous structure and/or wipe is not compressed.

For the wet test methods described herein (Soil Leak Through, CD Wet Initial Tensile Strength, Lotion Release, Saturation Loading, and Saturation Gradient Index), if the fibrous structure or wipe comprises a moisture level of 0% to less than about 100% by weight of the fibrous structure or wipe, then the following pre-conditioning procedure needs to be performed on the fibrous structure or wipe prior to testing. If the fibrous structure or wipe comprises a moisture level of about 100% or greater, then the following pre-conditioning procedure is not performed on the fibrous structure or wipe.

To pre-condition a fibrous structure or wipe comprising a moisture level of 0% to less than about 100% by weight of the fibrous structure or wipe, add an amount of distilled water to the fibrous structure or wipe to achieve a 3.5 g/g saturation loading on the fibrous structure or wipe.

After the fibrous structure or wipe is saturation loaded to a 3.5 g/g saturation loading, allow the fibrous structure or wipe to equilibrate to about 23° C.±2.2° C. and a relative humidity of 50%±10% for 24 hours prior to the testing. Care needs to be taken to ensure that the fibrous structure and/or wipe is not compressed.

Dry Test Methods

Liquid Absorptive Capacity Test Method

The following method, which is modeled after EDANA 10.4-02, is suitable to measure the Liquid Absorptive Capacity of any fibrous structure or wipe.

Prepare 5 samples of a pre-conditioned/conditioned fibrous structure or wipe for testing so that an average Liquid Absorptive Capacity of the 5 samples can be obtained.

Materials/Equipment

1. Flat stainless steel wire gauze sample holder with handle (commercially available from Humboldt Manufacturing Company) and flat stainless steel wire gauze (commercially available from McMaster-Carr) having a mesh size of 20 and having an overall size of at least 120 mm×120 mm
2. Dish of size suitable for submerging the sample holder, with sample attached, in a test liquid, described below, to a depth of approximately 20 mm
3. Binder Clips (commercially available from Staples) to hold the sample in place on the sample holder
4. Ring stand
5. Balance, which reads to four decimal places
6. Stopwatch
7. Test liquid: deionized water (resistivity>18 megaohms·cm)

Procedure

Prepare 5 samples of a fibrous structure or wipe for 5 separate Liquid Absorptive Capacity measurements. Individual test pieces are cut from the 5 samples to a size of approximately 100 mm×100 mm, and if an individual test piece weighs less than 1 gram, stack test pieces together to make sets that weigh at least 1 gram total. Fill the dish with a sufficient quantity of the test liquid described above, and allow it to equilibrate with room test conditions. Record the mass of the test piece(s) for the first measurement before fastening the test piece(s) to the wire gauze sample holder described above with the clips. While trying to avoid the creation of air bubbles, submerge the sample holder in the test liquid to a depth of approximately 20 mm and allow it to sit undisturbed for 60 seconds. After 60 seconds, remove the sample and sample holder from the test liquid. Remove all the binder clips but one, and attach the sample holder to the ring stand with the binder clip so that the sample may vertically hang freely and drain for a total of 120 seconds. After the conclusion of the draining period, gently remove the sample from the sample holder and record the sample's mass. Repeat for the remaining four test pieces or test piece sets.

Calculation of Liquid Absorptive Capacity

Liquid Absorptive Capacity is reported in units of grams of liquid composition per gram of the fibrous structure or wipe being tested. Liquid Absorptive Capacity is calculated as follows for each test that is conducted:

$$LiquidAbsorptive\ \text{Capacity} = \frac{M_X - M_i}{M_i}$$

In this equation, $M_i$ is the mass in grams of the test piece(s) prior to starting the test, and $M_X$ is the mass in grams of the same after conclusion of the test procedure. Liquid Absorptive Capacity is typically reported as the numerical average of at least five tests per sample.

Pore Volume Distribution Test Method

Pore Volume Distribution measurements are made on a TRI/Autoporosimeter (TRI/Princeton Inc. of Princeton, N.J.). The TRI/Autoporosimeter is an automated computer-controlled instrument for measuring pore volume distributions in porous materials (e.g., the volumes of different size pores within the range from 2.5 to 1000 □μm effective pore radii). Complimentary Automated Instrument Software, Release 2000.1, and Data Treatment Software, Release 2000.1 is used to capture, analyze and output the data. More information on the TRI/Autoporosimeter, its operation and data treatments can be found in The Journal of Colloid and Interface Science 162 (1994), pgs 163-170, incorporated here by reference.

As used in this application, determining Pore Volume Distribution involves recording the increment of liquid that enters a porous material as the surrounding air pressure changes. A sample in the test chamber is exposed to precisely controlled changes in air pressure. The size (radius) of the largest pore able to hold liquid is a function of the air pressure. As the air pressure increases (decreases), different size pore groups drain (absorb) liquid. The pore volume of each group is equal to this amount of liquid, as measured by the instrument at the corresponding pressure. The effective radius of a pore is related to the pressure differential by the following relationship.

$$\text{Pressure differential}=[(2)\ \gamma\ \cos\Theta]/\text{effective radius}$$

where $\gamma$=liquid surface tension, and $\Theta$=contact angle.

Typically pores are thought of in terms such as voids, holes or conduits in a porous material. It is important to note that this method uses the above equation to calculate effective pore radii based on the constants and equipment controlled pressures. The above equation assumes uniform cylindrical pores. Usually, the pores in natural and manufactured porous materials are not perfectly cylindrical, nor all uniform. Therefore, the effective radii reported here may not equate exactly to measurements of void dimensions obtained by other methods such as microscopy. However, these measurements do provide an accepted means to characterize relative differences in void structure between materials.

The equipment operates by changing the test chamber air pressure in user-specified increments, either by decreasing pressure (increasing pore size) to absorb liquid, or increasing pressure (decreasing pore size) to drain liquid. The liquid volume absorbed at each pressure increment is the cumulative volume for the group of all pores between the preceding pressure setting and the current setting.

In this application of the TRI/Autoporosimeter, the liquid is a 0.2 weight % solution of octylphenoxy polyethoxy ethanol (Triton X-100 from Union Carbide Chemical and Plastics Co. of Danbury, Conn.) in 99.8 weight % distilled water (specific gravity of solution is about 1.0). The instrument calculation constants are as follows: $\rho$(density)=1 g/cm$^3$; $\gamma$ (surface tension)=31 dynes/cm; $\cos\Theta$=1. A 0.22 μm Millipore Glass Filter (Millipore Corporation of Bedford, Mass.; Catalog # GSWP09025) is employed on the test chamber's porous plate. A plexiglass plate weighing about 24 g (supplied with the instrument) is placed on the sample to ensure the sample rests flat on the Millipore Filter. No additional weight is placed on the sample.

The remaining user specified inputs are described below. The sequence of pore sizes (pressures) for this application is as follows (effective pore radius in μm): 2.5, 5, 10, 15, 20, 30, 40, 50, 60, 70, 80, 90, 100, 120, 140, 160, 180, 200, 225, 250, 275, 300, 350, 400, 500, 600, 800, 1000. This sequence starts with the fibrous structure or wipe sample dry and saturates it as the pore settings increase (typically referred to with respect to the procedure and instrument as the 1$^{st}$ absorption).

In addition to the fibrous structure or wipe sample being tested, a blank condition (no sample between a plexiglass plate and Millipore Filter) is run to account for any surface and/or edge effects within the test chamber. Any pore volume measured for this blank condition is subtracted from the applicable pore grouping of the fibrous structure or wipe sample being tested. If upon subtracting the blank condition the result is 0 or negative then report a 0 for that pore range. This data treatment can be accomplished manually or with the available TRI/Autoporosimeter Data Treatment Software, Release 2000.1.

Percent (%) Total Pore Volume is a percentage calculated by taking the volume of fluid in the specific pore radii range divided by the Total Pore Volume. The TRI/Autoporosimeter outputs the volume of fluid within a range of pore radii. The first data obtained is for the "5.0 micron" pore radii which includes fluid absorbed between the pore sizes of 2.5 to 5.0 micron radius. The next data obtained is for "10 micron" pore radii, which includes fluid absorbed between the 5.0 to 10 micron radii, and so on. Following this logic, to obtain the volume held within the range of 91-140 micron radii, one would sum the volumes obtained in the range titled "100 micron", "110 micron", "120 micron", "130 micron", and finally the "140 micron" pore radii ranges. For example, % Total Pore Volume 91-140 micron pore radii=(volume of fluid between 91-140 micron pore radii)/Total Pore Volume. Total Pore Volume is the sum of all volumes of fluid between 2.5 micron and 1000 micron pore radii.

Basis Weight Test Method

Basis weight is measured prior to the application of any end-use lotion, cleaning solution, or other liquid composition, etc. to the fibrous structure or wipe, and follows a modified EDANA 40.3-90 (February 1996) method as described herein below.

1. Cut at least three test pieces of the fibrous structure or wipe to specific known dimensions, preferably using a pre-cut metal die and die press. Each test piece typically has an area of at least 0.01 m$^2$.
2. Use a balance to determine the mass of each test piece in grams; calculate basis weight (mass per unit area), in grams per square meter (gsm), using equation (1).

$$\text{Basis Weight} = \frac{\text{Mass of Test Piece (g)}}{\text{Area of Test Piece (m}^2\text{)}} \quad (1)$$

3. For a fibrous structure or wipe sample, report the numerical average basis weight for all test pieces.
4. If only a limited amount of the fibrous structure or wipe is available, basis weight may be measured and reported as the basis weight of one test piece, the largest rectangle possible.
5.

Dynamic Absorption Time (DAT) Test Method

DAT provides a measure of the ability of the fibrous structure or wipe to absorb a test liquid and the time it takes for the test liquid to be absorbed by the fibrous structure or wipe, which is in turn used as a measure of how well a fibrous structure or wipe will absorb liquid into the fibrous structure or wipe.

The DAT test method measures the dimensions of a drop of a liquid composition, in this case a drop of a lotion, from the moment it is in contact with a fibrous structure or wipe to when the drop is absorbed by the fibrous structure or wipe. The method also measures the rate of change of the dimensions of the drop with respect to time. Fibrous structures or wipes characterized by low DAT and low initial contact angle values may be more absorbent than those characterized by higher DAT and/or higher initial contact angle values.

Dynamic Absorbency Test (DAT) measurements of a fibrous structure or wipe are made utilizing a Thwing Albert DAT Fibro 1100 (Thwing Albert, Pa.). The DAT Fibro 1100 is an automated computer-controlled instrument for measuring contact angle of a drop of a liquid composition on porous materials and the time it takes for the drop of a liquid composition to absorb into the fibrous structure or wipe. Contact angle refers to the angle formed by the fibrous structure or wipe and the tangent to the surface of the liquid composition drop in contact with the fibrous structure or wipe. More information on absorbency of sheet materials using an automated contact angle tester can be found in ASTM D 5725-95.

The DAT contact angle measurements provide a means that is used in the art to characterize relative differences in absorbent properties of materials.

The equipment operates by controlling the volume and the ejection pulse of a small drop of a liquid composition discharged directly onto the surface of a fibrous structure or wipe. The height, base and angle produced as the liquid composition drop settles and becomes absorbed into the fibrous structure or wipe are determined based on an internal calibrated gray scale. In this application, a DAT Fibro 1100 series model (high speed camera resolution for porous absorbent paper substrates) is calibrated according to the manufacturer's instructions and using a 0.292 calibration sled. The instrument is set to discharge a 4 microliter (μL) drop of a liquid composition, a stroke pulse of 8, canula tip of 340, drop bottom of 208, and paper position of 134.

The fibrous structure or wipe samples to be tested are cut to approximately 0.5 inches in length and not exceeding the width of the sample sled associated with the testing equipment. The fibrous structure or wipe samples are cut along the MD direction of the fibrous structure or wipe to minimize neckdown and structural changes during handling. The fibrous structure or wipe samples as well as the liquid composition(s) to be dropped onto the fibrous structures or wipes are allowed to equilibrate to 23°±2.2° C. and 50% relative humidity for at least 4 hours. The liquid composition (s) are prepared by filling a clean dry syringe (0.9 mm diameter, part #1100406, Thwing Albert) at least half way. The syringe should be rinsed with the liquid composition of interest prior to the test and this can be achieved by filling/emptying the syringe 3 consecutive times with the liquid composition. In the present measurements, the liquid composition used is an aqueous composition that contains distilled water and a nonionic surfactant; namely, Triton® X 100, which is commercially available from Dow Chemical Company, at levels to result in the aqueous composition exhibiting a surface tension of 30 dynes/cm. The fibrous structure or wipe and the liquid composition are loaded into the instrument according to the manufacturer's instructions. The controlling software is designed to eject the liquid composition onto the fibrous structure or wipe and measure the following parameters: time for the liquid composition to absorb into fibrous structure or wipe, contact angle, base, height, and volume.

A total of 10 measurements of the time the liquid composition drop takes to be absorbed by the fibrous structure or wipe for each side of the fibrous structure or wipe are made. The reported DAT value (in seconds) is the average of the 20 measurements (10 from each side) of a fibrous structure or wipe.

Wet Test Methods

Soil Leak Through Test Method

The following method is used to measure the soil leak through value for a fibrous structure or wipe.

First, prepare a test composition to be used in the soil leak through test. The test composition is prepared by weighing out 8.6 g of Great Value Instant chocolate pudding mix (available from WalMart—do not use LowCal or Sugar Free pudding mix). Add 10 mL of distilled water to the 8.6 g of mix. Stir the mix until smooth to form the pudding. Cover the pudding and let stand at 23° C.±2.2° C. for 2 hours before use to allow thorough hydration of the pudding mix.

The Great Value Instant chocolate pudding mix can be purchased at http://www.walmart.com/ip/Great-Value-Chocolate-Instant-Pudding-3.9-oz/10534173. The ingredients listed on the Great Value Instant chocolate pudding mix are the following: Sugar, Modified Food Starch, Dextrose, Cocoa Powder Processed With Alkali, Disodium Phosphate, Contains 2% Or Less Of Nonfat Dry Milk, Tetrasodium Pyrophosphate, Salt, Natural And Artificial Flavoring, Mono- And Diglycerides (Prevent Foaming), Palm Oil, Red 40, Yellow 5, Blue 1. Titanium Dioxide (For Color). Allergy Warning: Contains Milk. May Contain Traces Of Eggs, Almonds, Coconut, Pecans, Pistachios, Peanuts, Wheat And Soy.

Transfer the test composition to a syringe using a sterile tongue depressor for ease of handling.

Tare weight of a piece of wax paper. The basis weight of the wax paper is about 35 gsm to about 40 gsm. Wax paper is supplied from the Reynolds Company under the Cut-Rite brand name. Weigh out 0.6±0.05 g of the test composition on the wax paper. Prepare 5 samples of a fibrous structure or wipe to be tested. The 5 samples of fibrous structure or wipe are cut, if necessary to dimensions of 150 mm×150 mm One of the 5 samples will be the control sample (no test composition will be applied to it). On a flat surface, place the wax paper with the test composition onto one of the remaining 4 test samples of fibrous structure or wipe that has been folded in half to create a two-ply structure such that the test composition is positioned between an exterior surface of the fibrous structure or wipe and the wax paper. Gently place a 500 g balance weight with a 1⅝ inch diameter (yielding about 0.5 psi) on the wax paper, e.g.,) for 10 seconds making sure not to press on the weight when placing the weight on the wax paper. 500 gram balance weights are available from the McMaster-Carr Company. After the 10 seconds, remove the weight and gently unfold the fibrous structure or wipe. Examine the soil color visible from the interior surface of the de facto "second ply" (the surface of the portion of the fibrous structure or wipe that is facing inward and is not the backside of the portion of the fibrous structure or wipe to which the test composition was applied). A Hunter Color Lab Scan is used to examine this interior surface. The color may diffuse over time; so examine the wipes at a consistent time interval (within 10 minutes after placing the weight on the wax paper) for better sample to sample comparison. Repeat the test composition application procedure for the remaining test samples of fibrous structure or wipe.

The color present on the interior surface of each test sample of fibrous structure or wipe to be analyzed is then analyzed using a Hunter Color Lab instrument.

Hunter Color Lab Scan Procedure (Calibration)

1. Set scale to XYZ.
2. Set observer to 10.
3. Set both illuminations to D65.
4. Set procedure to none and click ok.
5. Check to see if read procedures is set to none.
6. Place green plate on port and click read sample. Enter sample ID green.
7. Place white plate on port and click read sample. Enter sample ID white.
8. Open calibration excel file, click on file save as and enter today's date.
9. Go back to test page of hunter color and highlight XY&Z numbers, click on edit, copy.
10. Open up today's calibration sheet and paste numbers in the value read cell. Check value read to actual value. Values must be within specs to pass.
11. Printout calibration report.

(Test)

1. Click on active view.
2. Set Scale to Cielab.
3. Set both illuminate to C.
4. Set observer to 2.
5. Set procedure to none.
6. Click ok.
7. Click clear all.
8. Scan the control sample to measure and record the L value of the control sample.
9. After removing the weight from a test sample of fibrous structure or wipe as described above, unfold the test sample and place the test sample of fibrous structure or wipe on instrument port such that the color of the interior surface of the de facto "second ply" as described above can be analyzed. Place a fresh piece of wax paper on top of the test sample to avoid contaminating the instrument.
10. Click read sample to measure and record the L value of the test sample. Enter name of sample. Click ok. Repeat for the remaining test samples.
11. After the L values of the 4 test samples have been measured and recorded, average the L values for the 4 test samples.
12. Calculate the Soil Leak Through Lr Value for the fibrous structure or wipe tested by determining the difference between the L value of the control sample and the average L value of the 4 test samples.

The reported Soil Leak Through Lr Value is the difference in the L color value from the Hunter Color Lab between the control sample and the test sample of the fibrous structure or wipe. A Soil Leak Through Lr Value of less than 20 and/or less than 15 and/or less than 10 and/or less than 5 and/or less than 2 is desirable. The lower the value, the more the fibrous structure or wipe prevents soil leak through.

A suitable equivalent to the Great Value Instant chocolate pudding mix test composition can be made by the following procedure for use in the test method described above.

First, a test composition for testing purposes is prepared. In order to make the test composition, a dry powder mix is first made. The dry powder mix comprises dehydrated tomato dices (Harmony House or NorthBay); dehydrated spinach flakes (,Harmony House or NorthBay); dehydrated cabbage (Harmony House or NorthBay); whole psyllium husk (available from Now Healthy Foods that has to be sieved with 600 μm cutoff to collect greater than 600 μm particles and then ground to collect 250-300 μm particles) (alternatively available from Barry Farm as a powder that has to be sieved to collect 250-300 μm particles); palmitic acid (95% Alfa Aeser B20322); and calcium stearate (Alfa Aeser 39423). Next add food grade yeast powders commercially available as Provesta® 000 and Ohly® HTC (both commercially available from Ohly Americas, Hutchinson, Minn.).

If grinding of the vegetables needs to be performed, an IKA All basic grinder (commercially available from VWR or Rose Scientific LTD) is used. To grind the vegetables, add the vegetable flakes to the grinding bowl. Fill to the mark (within the metal cup, do not over fill). Power on for 5 seconds. Stop. Tap powder 5 times. Repeat power on (for 5 seconds), stop and tap powder (5 times) procedure 4 more times. Sieve the ground powder by stacking a 600 um opening sieve on top of a 300 μm opening sieve such that powders of 300 μm or less are collected. Regrind any remaining powders that are larger than 300 μm one time. Collect powders of 300 μm or less.

The test composition is prepared by mixing the above identified ingredients in the following levels in Table 3 below.

TABLE 3

| Soil Powder Premix | Grams | % |
|---|---|---|
| Tomato Powder | 20.059 | 18.353 |
| Psyllium Husk | 0.599 | 0.548 |
| Cabbage | 2.145 | 1.963 |
| Spinach Powder | 8.129 | 7.438 |
| Provesta 000 | 40.906 | 37.428 |
| Ohly HCT | 16.628 | 15.214 |
| Palmitic acid/Calcium Stearate (2:1) | 20.827 | 19.056 |

The palmitic acid/calcium stearate blend is prepared by grinding together and collecting powders of 300 μm or less from a blend of 20.0005 g palmitic acid and 10.006 g calcium stearate.

To make up the test composition, 21 g of distilled water at 23° C.±2.2° C. is added to every 9 g of the soil powder premix described above in Table 3 used in a suitable container. A tongue depressor is used to stir the composition until the composition, which may be a paste, is homogeneous, about 2 minutes of stirring. Cover the container loosely with a piece of aluminum foil and let stand for 2 hours at 23°±2.2° C. Next add 4 drops of FD&C Red Dye #40 and stir until completely mixed, about 2 minutes of stirring. The test composition is ready for use in the soil leak through test.

CD Wet Initial Tensile Strength Test Method

The CD Wet Initial Tensile Strength of a fibrous structure or wipe is determined using a modified EDANA 20.2.89 method, which generally sets forth the following test method.

Cut 5-50±0.5 mm wide (MD) and more than 150 mm long (CD) test strips (so that a distance of 100 mm can be obtained between the jaws of the dynamometer) of the fibrous structure or wipe to be tested with a laboratory paper cutter or a template and scalpel (not scissors, as the test pieces must be cut out cleanly according to ERT 130).

Using a tensile testing machine (dynamometer) with a constant rate of extension (100 mm/min) and jaws 50 mm wide (capable of holding the cut sample securely across their full widths without damage) and fitted with a system for recording force-elongation curves.

Place a strip to be tested in the jaws of the tensile testing machine, the jaws being 100 mm±1 mm apart.

Apply a constant rate of extension (100 mm/min) and record the force-elongation curve.

Discard the results from any test strip where the break occurs in the clamp or where any break reaches the jaws.

Establish the scale of force-elongation curve. Use the force-elongation curve to determine the CD Wet Initial Tensile Strength in newtons (N). If several peak values for the applied force occur during the test, take the highest value as the CD Wet Initial Tensile Strength of the strip and note this in the test report. Repeat the procedure on additional strips from the fibrous structure wipe to get an average CD Wet Initial Tensile Strength from 5 samples, which is the reported CD Wet Initial Tensile Strength in N to the nearest 0.1 N.

Lotion Release Test Method

The lotion release of a fibrous structure or wipe is determined by wiping the fibrous structure or wipe over a defined area, using a defined pressure and default speed of the instrument.

A wiping apparatus capable of simulating a wiping process is used. A suitable wiping apparatus is available from Manfred Führer GmbH, D-60489 Frankfurt, GERMANY. The wiping apparatus has a surface on which a skin analogue (a self-adhesive DC fix foil 40 cm×40 cm available from Konrad Hornschuch AG, 74679 Weissbach, GERMANY,) is placed. The wiping apparatus further has a mechanical arm with a wiping hand (180 mm×78 mm) attached that applies a wiping pressure of 8.5 g/cm$^2$ to the skin analog.

To run the test, place the skin analogue on the surface of the wiping apparatus. With nitrile/powder free gloves on, weigh a fibrous structure or wipe to be tested to get its initial mass. Unfold the fibrous structure or wipe, if folded, and place it onto the already stuck skin analogue. Gently place the wiping hand on the top of the fibrous structure or wipe. Tightly attach the fibrous structure or wipe to the wiping hand such that only a 180 mm×78 mm portion of the fibrous structure or wipe will come into contact with the skin analogue when the wiping movements of the wiping hand are performed. Ensure that the wiping apparatus is on and perform 3 wiping movements. The first wiping movement is a 90° stroke of the wiping arm including the wiping hand and fibrous structure or wipe attached thereto. The second wiping movement is a 90° return stroke over the same portion of the skin analogue that the first wiping movement traveled. The third wiping movement is another 90° stroke of the wiping arm including the wiping hand and fibrous structure or wipe attached thereto, like the first wiping movement, and it travels over the same portion of the skin analogue as the first and second wiping movements. Carefully remove the fibrous structure or wipe from the wiping hand being careful not to wipe the fibrous structure or wipe on the skin analogue while removing it from the wiping hand. Weigh the fibrous structure or wipe again to obtain the final mass. The lotion release for the fibrous structure or wipe is the difference between the initial mass of the fibrous structure or wipe and the final mass of the fibrous structure or wipe. Clean the skin analogue with a dry tissue. Repeat the procedure again starting with weighing the next fibrous structure or wipe to get its initial mass. The reported lotion release value is the average lotion release value of 10 tested fibrous structures or wipes The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A wet wipe comprising a liquid composition, wherein the wet wipe comprises a fibrous structure and a scrim present on at least one side of the fibrous structure, wherein the wet wipe exhibits a Liquid Absorptive Capacity of greater than 12 g/g as measured according to the Liquid Absorptive Capacity Test Method.

2. The wet wipe according to claim 1 wherein the wet wipe exhibits a Liquid Absorptive Capacity of greater than 13 g/g as measured according to the Liquid Absorptive Capacity Test Method.

3. The wet wipe according to claim 1 wherein the wet wipe exhibits a Soil Leak Through Lr Value of less than 8.5 as measured according to the Soil Leak Through Test Method.

4. The wet wipe according to claim 3 wherein the wet wipe exhibits a Soil Leak Through Lr Value of less than 2 as measured according to the Soil Leak Through Test Method.

5. The wet wipe according to claim 1 wherein the wet wipe exhibits a CD Wet Initial Tensile Strength of greater than 5.0 N as measured according to the CD Wet Initial Tensile Strength Test Method.

6. The wet wipe according to claim 1 wherein the Basis Weight of the wet wipe is less than 55 g/m$^2$ as measured according to the Basis Weight Test Method.

7. The wet wipe according to claim 1 wherein the fibrous structure is a co-formed fibrous structure.

8. The wet wipe according to claim 1 wherein the scrim comprises meltblown filaments.

9. The wet wipe according to claim 1 wherein the liquid composition comprises a lotion composition.

10. The wet wipe according to claim 9 wherein the wet wipe exhibits a Lotion Release of greater than 0.25 as measured according to the Lotion Release Test Method.

11. The wet wipe according to claim 9 wherein the wet wipe exhibits a DAT of less than 0.04 as measured according to the DAT Test Method.

12. The wet wipe according to claim 9 wherein a stack of the wet wipes exhibits a Saturation Gradient Index of less than 1.5.

13. The wet wipe according to claim 1 wherein the fibrous structure comprises a plurality of filaments.

14. The wet wipe according to claim 13 wherein the wet wipe further comprises a plurality of solid additives.

15. The wet wipe according to claim 14 wherein at least one of the solid additives comprises a fiber.

16. The wet wipe according to claim 15 wherein the fiber comprises a wood pulp fiber.

17. The wet wipe according to claim 16 wherein the wood pulp fiber is selected from the group consisting of: Southern Softwood Kraft pulp fibers, Northern Softwood Kraft pulp fibers, Eucalyptus pulp fibers, Acacia pulp fibers.

18. The wet wipe according to claim 13 wherein at least one of the filaments comprises a thermoplastic polymer.

19. The wet wipe according to claim 18 wherein the thermoplastic polymer is selected from the group consisting of: polypropylene, polyethylene, polyester, polylactic acid, polyhydroxyalkanoate, polyvinyl alcohol, polycaprolactone and mixtures thereof.

20. The wet wipe according to claim 1 wherein the wet wipe is an embossed wet wipe.

* * * * *